US009127575B2

(12) United States Patent
Fischer et al.

(10) Patent No.: US 9,127,575 B2
(45) **Date of Patent: *Sep. 8, 2015**

(54) CAMSHAFT PHASER WITH COAXIAL CONTROL VALVES

(71) Applicant: DELPHI TECHNOLOGIES, INC., Troy, MI (US)

(72) Inventors: Thomas H. Fischer, Rochester, NY (US); Thomas H. Lichti, Victor, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/091,693

(22) Filed: Nov. 27, 2013

(65) Prior Publication Data

US 2014/0083385 A1 Mar. 27, 2014

Related U.S. Application Data

(63) Continuation of application No. 13/049,167, filed on Mar. 16, 2011, now Pat. No. 8,662,039.

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/3443* (2013.01); *F01L 2001/34426* (2013.01); *F01L 2001/34433* (2013.01); *F01L 2001/34453* (2013.01); *F01L 2001/34479* (2013.01)

(58) Field of Classification Search
CPC ..... F01L 1/344; F01L 1/3442; F01L 2001/34426; F01L 2001/3443; F01L 2001/34453; F01L 2001/34479
USPC ..... 123/90.17, 90.15
See application file for complete search history.

(56) References Cited

U.S. PATENT DOCUMENTS

| | | | |
|---|---|---|---|
| 5,234,092 | A | 8/1993 | Mahoney |
| 5,901,674 | A | 5/1999 | Fujiwaki |
| 6,968,813 | B2 | 11/2005 | Isobe et al. |
| 7,444,968 | B2 | 11/2008 | Lancefield et al. |
| 7,487,752 | B2 | 2/2009 | Strauss et al. |

(Continued)

FOREIGN PATENT DOCUMENTS

| | | | |
|---|---|---|---|
| DE | 102006012348 | A1 | 9/2007 |
| DE | 102006012349 | A1 | 9/2007 |
| EP | 1462650 | A2 | 9/2004 |

*Primary Examiner* — Ching Chang
(74) *Attorney, Agent, or Firm* — Thomas N. Twomey

(57) ABSTRACT

A camshaft phaser is provided for varying the phase relationship between a crankshaft and a camshaft in an engine. The camshaft phaser includes a stator having lobes. A rotor is disposed within the stator includes vanes interspersed with the stator lobes to define alternating advance and retard chambers. A lock pin is provided for selective engagement with a lock pin seat for preventing relative rotation between the rotor and the stator. Pressurized oil disengages the lock pin from the seat while oil is vented for engaging the lock pin with the seat. A phase relationship control valve is coaxial with the rotor and controls the flow of oil into and out of the chambers. A lock pin control valve is coaxial with the phase relationship control valve and controls the flow of oil to and from the lock pin. The control valves are operational independent of each other.

8 Claims, 18 Drawing Sheets

(56) References Cited

U.S. PATENT DOCUMENTS

| | | | | |
|---|---|---|---|---|
| 7,513,230 | B2 | 4/2009 | Knecht et al. | |
| 7,533,695 | B2 | 5/2009 | Strauss et al. | |
| 7,597,076 | B2 | 10/2009 | Strauss et al. | |
| 7,946,266 | B2 | 5/2011 | Knecht et al. | |
| 8,006,660 | B2 | 8/2011 | Strauss et al. | |
| 8,047,170 | B2 | 11/2011 | Strauss et al. | |
| 8,156,906 | B2 | 4/2012 | Takenaka | |
| 8,166,937 | B2 | 5/2012 | Yamaguchi et al. | |
| 8,186,319 | B2 | 5/2012 | Pluta et al. | |
| 8,322,317 | B2 | 12/2012 | Suzuki et al. | |
| 8,336,510 | B2 | 12/2012 | Asahi et al. | |
| 8,534,246 | B2 * | 9/2013 | Lichti et al. | 123/90.17 |
| 8,662,039 | B2 * | 3/2014 | Fischer et al. | 123/90.17 |
| 2003/0015157 | A1 | 1/2003 | Knecht et al. | |
| 2004/0055550 | A1 | 3/2004 | Smith | |
| 2007/0056540 | A1 | 3/2007 | Hoppe et al. | |
| 2007/0095315 | A1 | 5/2007 | Hoppe et al. | |
| 2007/0119402 | A1 | 5/2007 | Lancefield et al. | |
| 2007/0204824 | A1 | 9/2007 | Strauss et al. | |
| 2008/0245324 | A1 | 10/2008 | Hoppe et al. | |
| 2009/0159024 | A1 | 6/2009 | Paul et al. | |
| 2009/0266322 | A1 | 10/2009 | Fischer | |
| 2010/0000479 | A1 | 1/2010 | Strauss et al. | |
| 2010/0139593 | A1 | 6/2010 | Takemura | |
| 2010/0186697 | A1 | 7/2010 | Suzuki et al. | |
| 2010/0288215 | A1 | 11/2010 | Takemura et al. | |
| 2010/0319641 | A1 | 12/2010 | Suzuki et al. | |
| 2011/0259289 | A1 | 10/2011 | Fujiyoshi | |
| 2011/0303169 | A1 | 12/2011 | Nakamura et al. | |
| 2012/0097122 | A1 | 4/2012 | Lichti | |
| 2012/0145099 | A1 | 6/2012 | Kato et al. | |
| 2012/0145100 | A1 | 6/2012 | Meinig et al. | |
| 2012/0145105 | A1 | 6/2012 | Bayrakdar | |
| 2012/0186547 | A1 | 7/2012 | Fujiyoshi et al. | |
| 2012/0210961 | A1 | 8/2012 | Scheidig | |
| 2012/0210962 | A1 | 8/2012 | Hoppe et al. | |
| 2012/0210963 | A1 | 8/2012 | Bayrakdar | |
| 2012/0234275 | A1 | 9/2012 | Fischer et al. | |
| 2012/0255509 | A1 | 10/2012 | Lichti et al. | |
| 2012/0318219 | A1 | 12/2012 | Fischer | |
| 2012/0325169 | A1 | 12/2012 | Draheim | |

* cited by examiner

CAMSHAFT PHASER WITH COAXIAL CONTROL VALVES

CROSS REFERENCE TO RELATED APPLICATIONS

This application is a continuation of U.S. patent application Ser. No. 13/049,167 filed on Mar. 16, 2011, the disclosure of which is incorporated herein by reference in its entirety.

TECHNICAL FIELD OF INVENTION

The present invention relates to a hydraulically actuated camshaft phaser for varying the phase relationship between a crankshaft and a camshaft in an internal combustion engine; more particularly to such a camshaft phaser that is a vane-type camshaft phaser, and more particularly to a vane-type camshaft phaser which includes a first oil control valve located coaxially within the camshaft phaser to control engagement and disengagement of a lock pin and a second oil control valve that is coaxial with the first oil control valve for varying the phase relationship between the crankshaft and the camshaft.

BACKGROUND OF INVENTION

A typical vane-type camshaft phaser generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance and retard chambers in order to rotate the rotor within the stator and thereby change the phase relationship between an engine camshaft and an engine crankshaft. Camshaft phasers also commonly include an intermediate lock pin which selectively prevents relative rotation between the rotor and the stator at an angular position that is intermediate of a full advance and a full retard position. The intermediate lock pin is engaged and disengaged by vented oil from the intermediate lock pin and supplying pressurized oil to the intermediate lock pin respectively.

Some camshaft phasers utilize one or more oil control valves located in the internal combustion engine to control the flow of pressurized oil to and from the advance chambers, retard chambers, and lock pin. One example of such a camshaft phaser is shown in United States Patent Application Publication number 2010/0288215. In this arrangement, three separate supply signals need to be included in the camshaft bearing for communication to the camshaft phaser. More specifically, a first passage for the advance chambers, a second passage for the retard chambers, and a third passage for the lock pin is included in the camshaft bearing. Including three separate passages in the camshaft bearing undesirably increases the length of the camshaft bearing. Additionally, space may be limited in the internal combustion engine to package oil control valves therein which are needed to control oil to and from each of the three passages.

In order to eliminate the packaging concerns and increased camshaft bearing length issues associated with packaging the oil control valve in the internal combustion engine, some manufacturers have included the oil control valve coaxially within the camshaft phaser. While this arrangement is common for oil control valves that need to supply oil to the advance and retard chambers, the arrangement is less common for oil control valves that need to supply oil not only to the advance and retard chambers, but the intermediate lock pin as well. One example of such a camshaft phaser is shown in United States Patent Application Publication number 2004/0055550. However, including a single oil control valve coaxially within the camshaft phaser to control oil to the lock pin in addition to the advance and retard chambers requires an increased camshaft phaser thickness in order to accommodate the passage supplying oil to and from the lock pin. A single oil control valve also prevents independent control of the lock pin function and the phasing function which may make engaging the intermediate lock pin with its lock pin seat difficult.

What is needed is an axially compact camshaft phaser with valving located coaxially within the camshaft phaser for controlling the phase relationship and for controlling the lock pin. What is also needed is such a camshaft phaser which allows for control of the phase relationship independent of the lock pin.

SUMMARY OF THE INVENTION

Briefly described, a camshaft phaser is provided for controllably varying the phase relationship between a crankshaft and a camshaft in an internal combustion engine. The camshaft phaser includes a stator having a plurality of lobes and connectable to the crankshaft of the internal combustion engine to provide a fixed ratio of rotation between the stator and the crankshaft. The camshaft phaser also includes a rotor coaxially disposed within the stator and having a plurality of vanes interspersed with the stator lobes defining alternating advance chambers and retard chambers. The advance chambers receive pressurized oil in order to change the phase relationship between the crankshaft and the camshaft in the advance direction while the retard chambers receive pressurized oil in order to change the phase relationship between the camshaft and the crankshaft in the retard direction. The rotor is attachable to the camshaft of the internal combustion engine to prevent relative rotation between the rotor and the camshaft. A lock pin is disposed within one of the rotor and the stator for selective engagement with a lock pin seat in the other of the rotor and the stator for substantially preventing relative rotation between the rotor and the stator when the lock pin is engaged with the lock pin seat. Pressurized oil is selectively supplied to the lock pin in order to disengage the lock pin from the lock pin seat while oil is selectively vented from the lock pin in order to engage the lock pin with the lock pin seat. A phase relationship control valve which is coaxial with the rotor is provided for controlling the flow of oil into and out of the advance and retard chambers. A lock pin control valve which is coaxial with the phase relationship control valve is provided for controlling the flow of oil to and from the lock pin. The phase relationship control valve is operational independent of the lock pin control valve.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which:

FIG. 2B' is an enlarged view of the pertinent elements of FIG. 2B without reference numbers to clearly shown the oil flow through the camshaft phaser;

FIG. 2C' is an enlarged view of the pertinent elements of FIG. 2C without reference numbers to clearly shown the oil flow through the camshaft phaser;

FIG. 3A' is an enlarged view of the pertinent elements of FIG. 3A without reference numbers to clearly shown the oil flow through the camshaft phaser;

FIG. 3B' is an enlarged view of the pertinent elements of FIG. 3B without reference numbers to clearly shown the oil flow through the camshaft phaser;

FIG. 7A' is an enlarged view of the pertinent elements of FIG. 7A without reference numbers to clearly show the oil flow through the camshaft phaser;

FIG. 7B' is an enlarged view of the pertinent elements of FIG. 7B without reference numbers to clearly show the oil flow through the camshaft phaser;

DETAILED DESCRIPTION OF INVENTION

Figure 1:
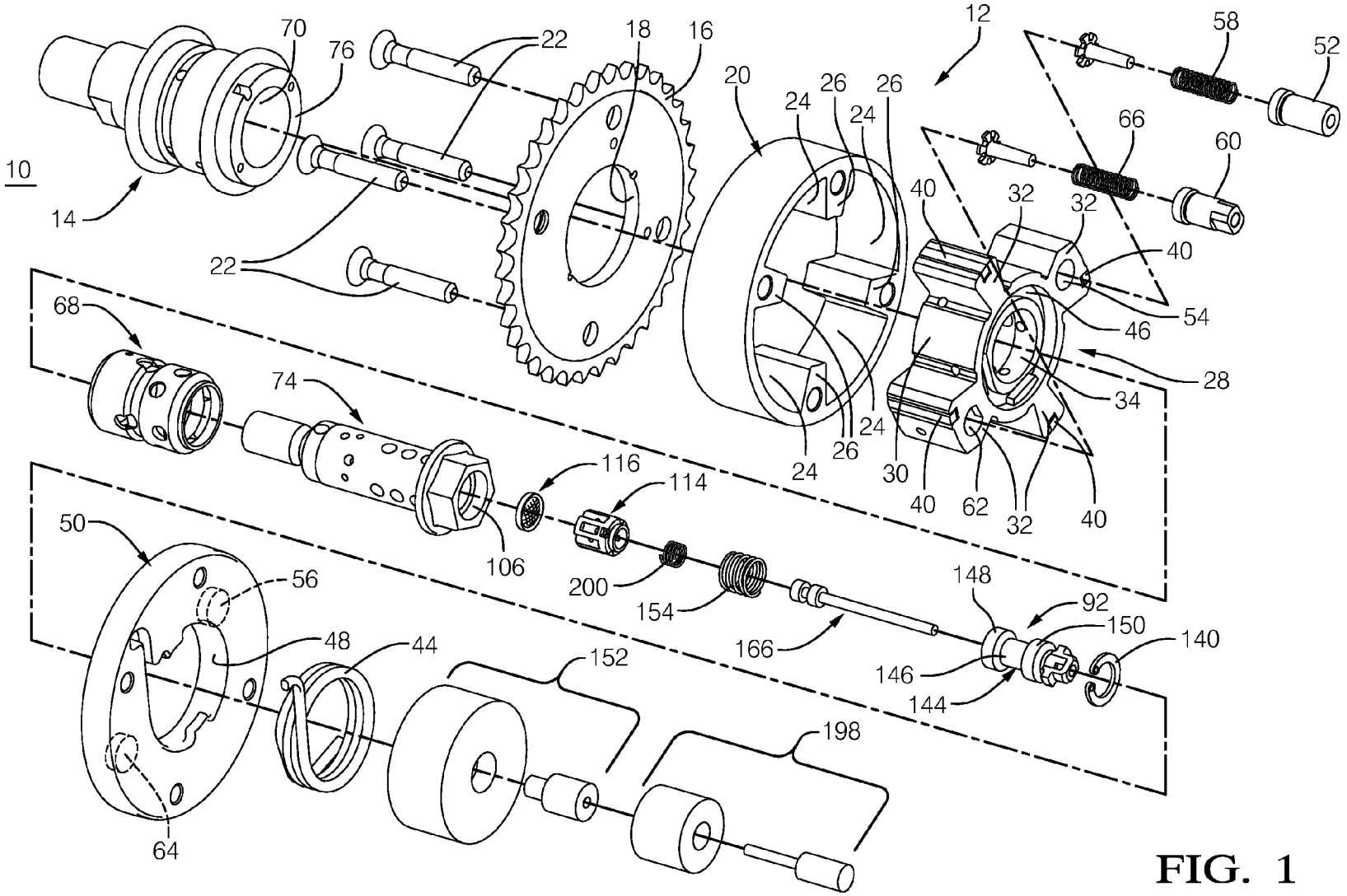
FIG. 1 is an exploded isometric view of a camshaft phaser in accordance with the present invention.
Figure 2A:
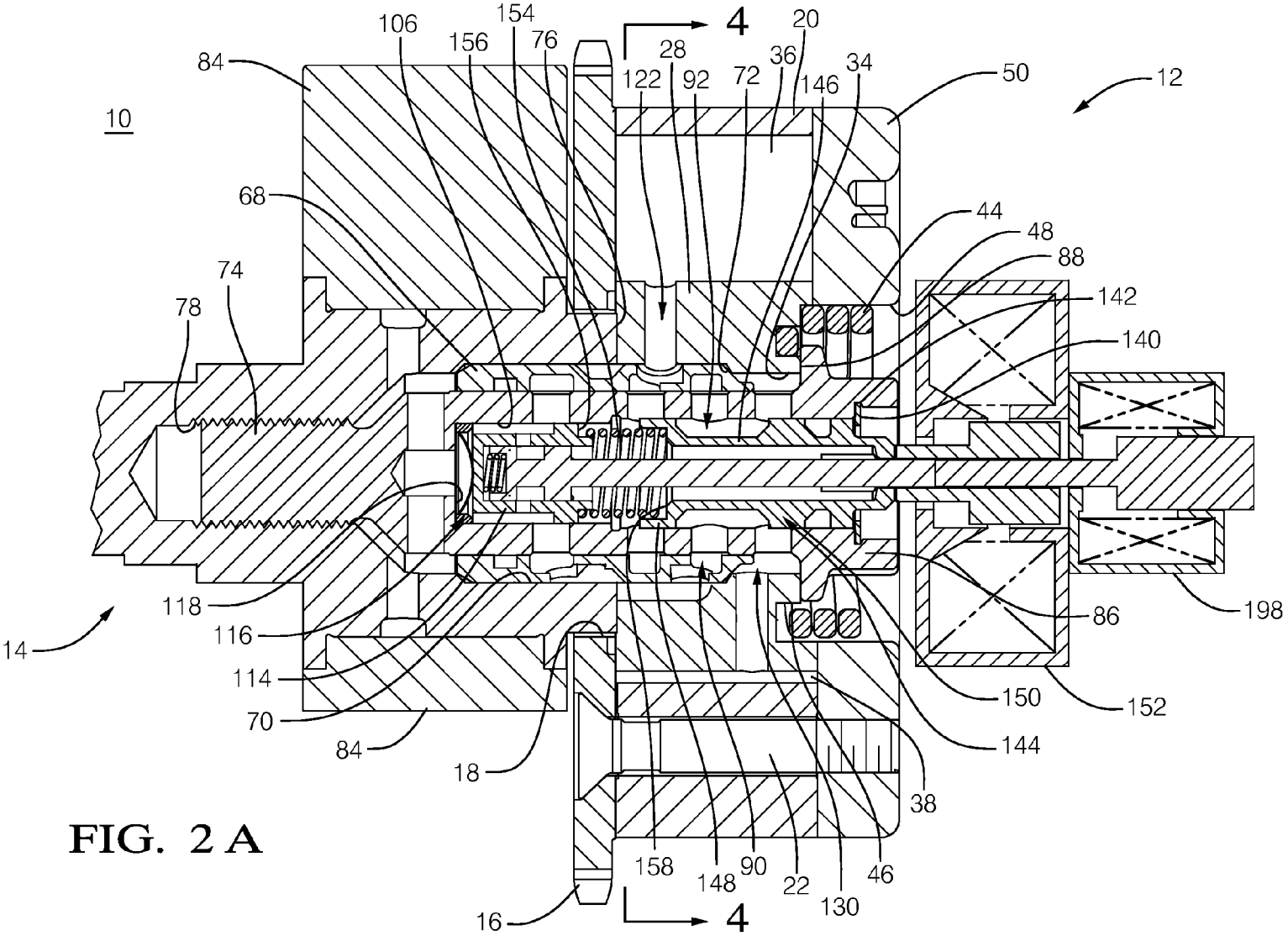
FIG. 2A is an axial cross-section of the camshaft phaser in accordance with the present invention.
Figure 4:
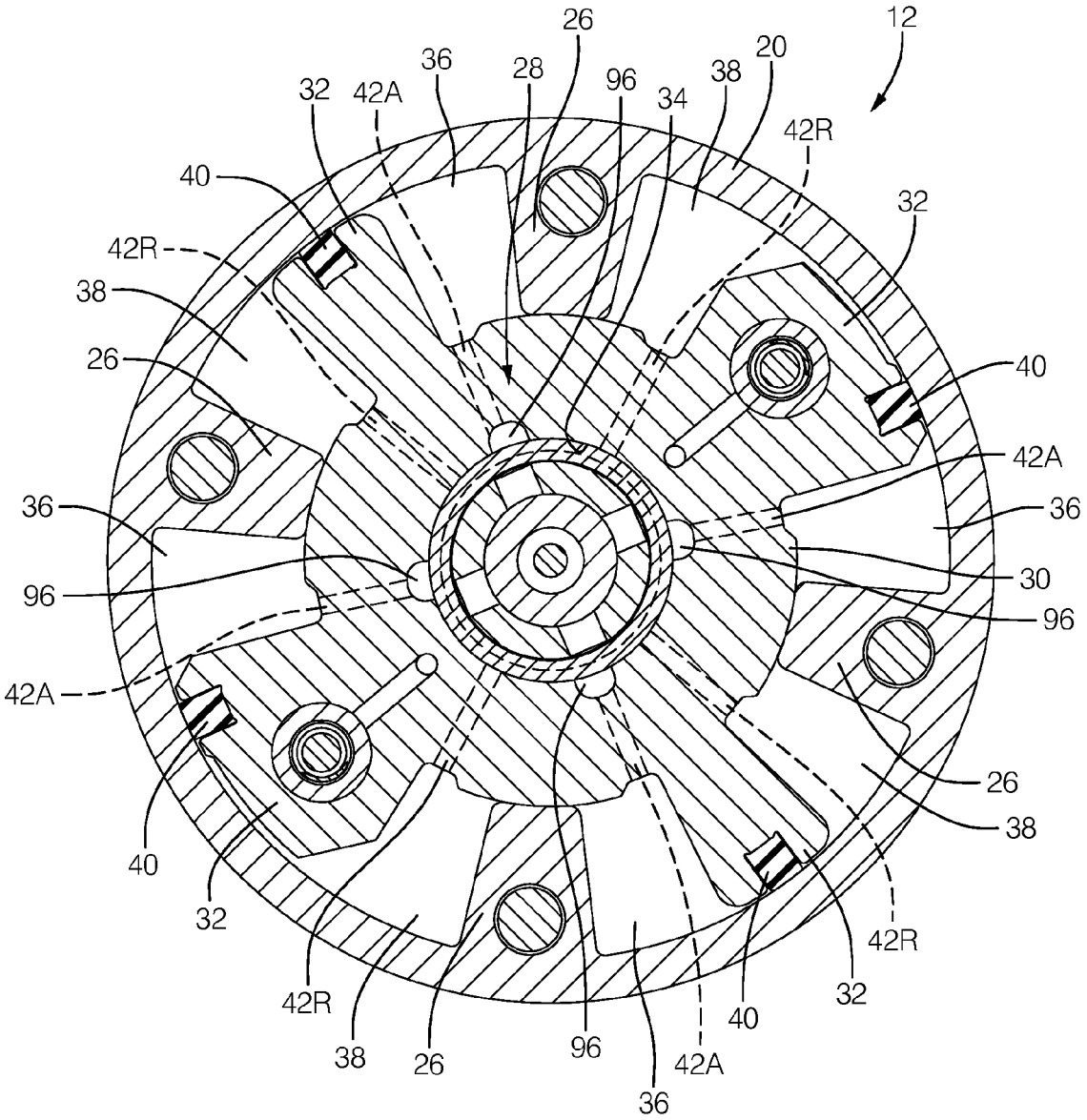
FIG. 4 is a radial cross-section of the camshaft phaser taken in the direction of arrows 4 in FIG. 2A.
Figure 5A:
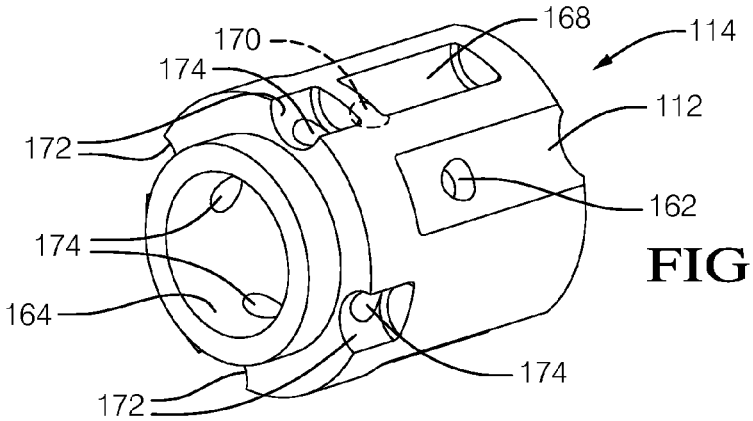
FIGS. 5A-5D are enlarged isometric views of a manifold of the camshaft phaser where each Fig. is shown rotated 90° from the previous view.
Figure 5B:
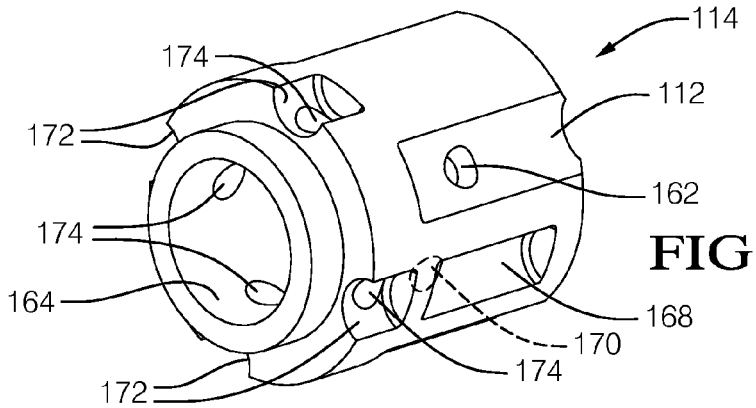
Figure 5C:
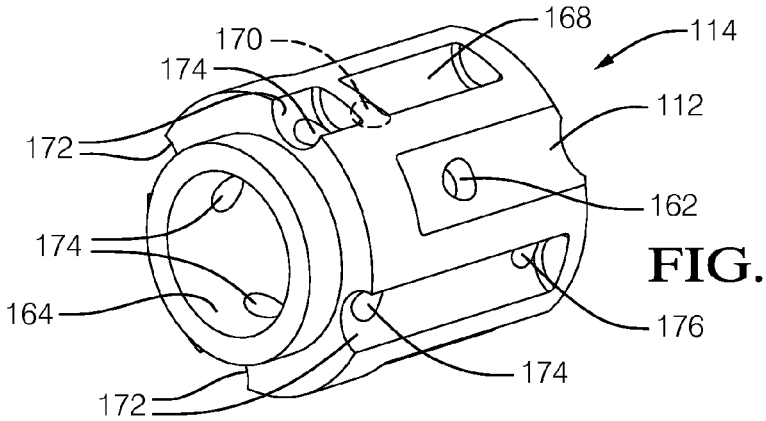
Figure 5D:
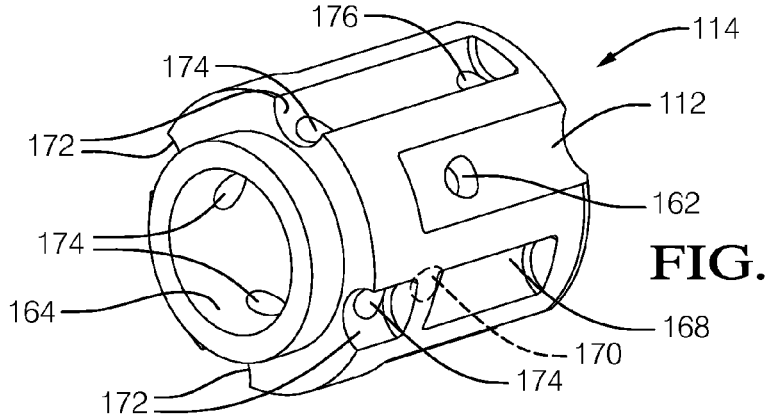
Figure 6A:
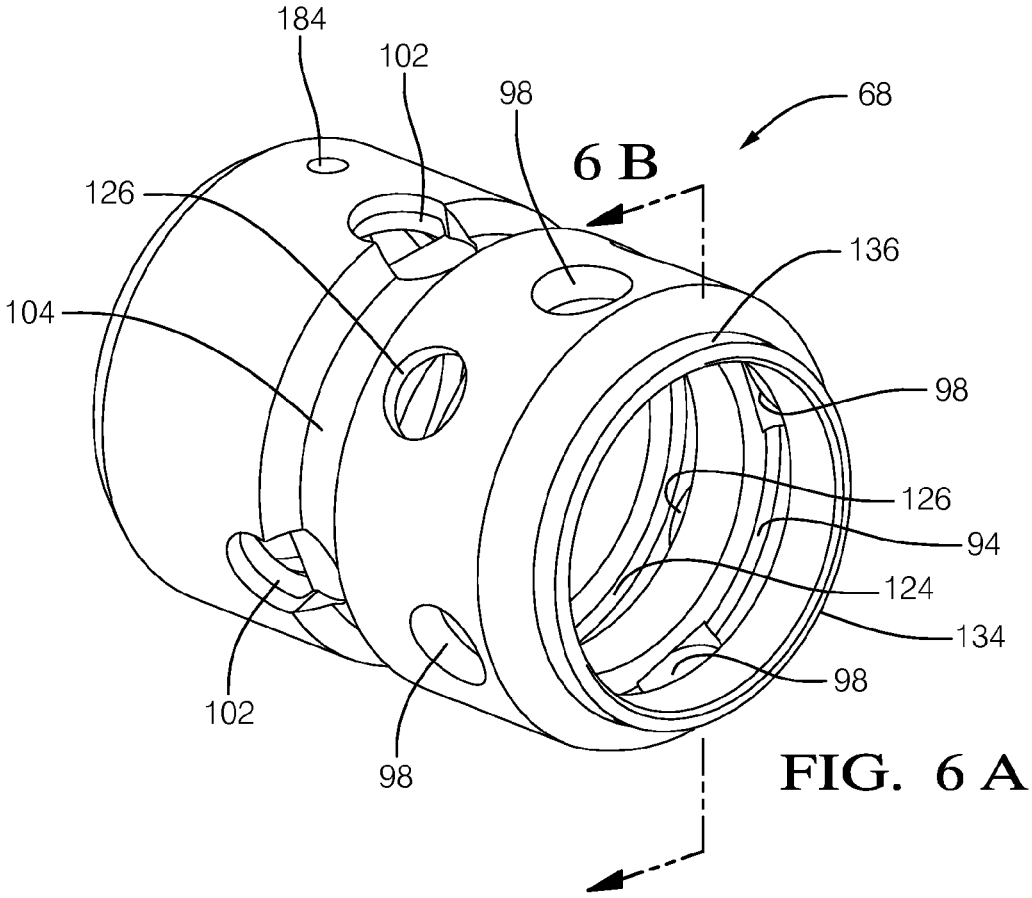
FIG. 6A is an enlarged isometric view of a bushing adaptor of the camshaft phaser.
Figure 6B:
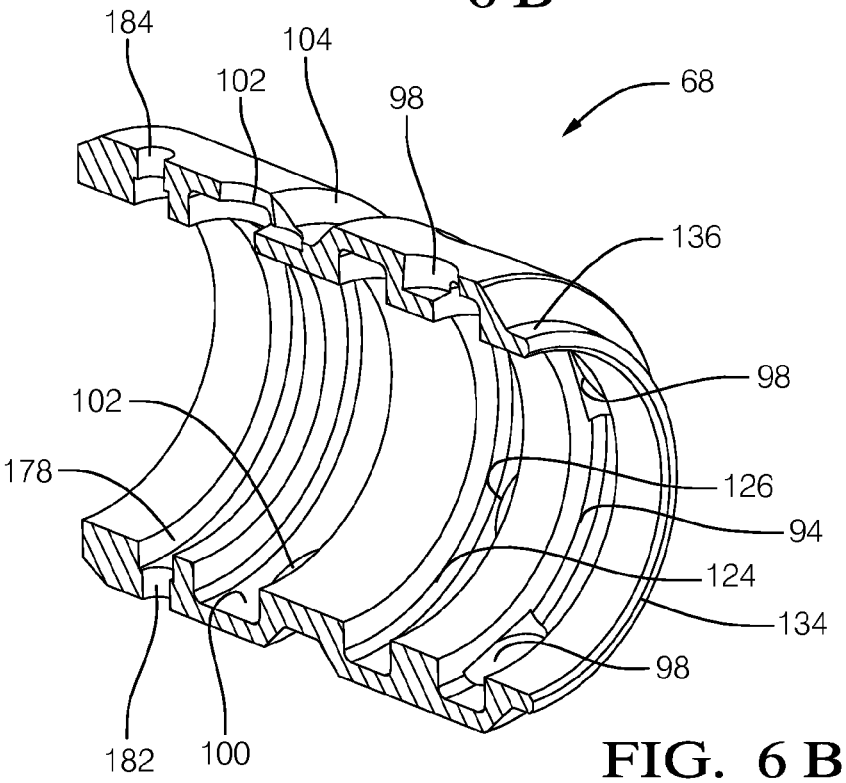
FIG. 6B is an isometric cross-section of the bushing adaptor of FIG. 6A.

In accordance with a preferred embodiment of this invention and referring to FIGS. 1, 2A, and 4, internal combustion engine 10 is shown which includes camshaft phaser 12. Internal combustion engine 10 also includes camshaft 14 which is rotatable based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 includes sprocket 16 which is driven by a chain or gear (not shown) driven by the crankshaft of internal combustion engine 10. Alternatively, sprocket 16 may be a pulley driven by a belt. Sprocket 16 includes a central bore 18 for receiving camshaft 14 coaxially therethrough which is allowed to rotate relative to sprocket 16. Sprocket 16 is sealingly secured to stator 20 with sprocket bolts 22 in a way that will be described in more detail later.

Stator 20 is generally cylindrical and includes a plurality of radial chambers 24 defined by a plurality of lobes 26 extending radially inward. In the embodiment shown, there are four lobes 26 defining four radial chambers 24, however, it is to be understood that a different number of lobes may be provided to define radial chambers equal in quantity to the number of lobes.

Rotor 28 includes central hub 30 with a plurality of vanes 32 extending radially outward therefrom and central through bore 34 which is stepped and extends axially therethrough. The number of vanes 32 is equal to the number of radial chambers 24 provided in stator 20. Rotor 28 is coaxially disposed within stator 20 such that each vane 32 divides each radial chamber 24 into advance chambers 36 and retard chambers 38. The radial tips of lobes 26 are mateable with central hub 30 in order to separate radial chambers 24 from each other. Preferably, each of the radial tips of vanes 32 includes one of a plurality of wiper seals 40 to substantially seal adjacent advance and retard chambers 36, 38 from each other. Although not shown, each of the radial tips of lobes 26 may include a wiper seal similar in configuration to wiper seal 40.

Central hub 30 includes a plurality of oil passages 42A, 42R formed radially therethrough (best visible as hidden lines in FIG. 4). Each one of the plurality of oil passages 42A is in fluid communication with one of the advance chambers 36 for supplying oil thereto and therefrom while each one of the plurality of oil passages 42R is in fluid communication with one of the retard chambers 38 for supplying oil thereto and therefrom.

Bias spring 44 is disposed within annular pocket 46 formed in rotor 28 and within central bore 48 of camshaft phaser cover 50. Bias spring 44 is grounded at one end thereof to camshaft phaser cover 50 and is attached at the other end thereof to rotor 28. When internal combustion engine 10 is shut down, bias spring 44 urges rotor 28 to a predetermined angular position within stator 20 in a way that will be described in more detail in the subsequent paragraph.

Figure 3A:
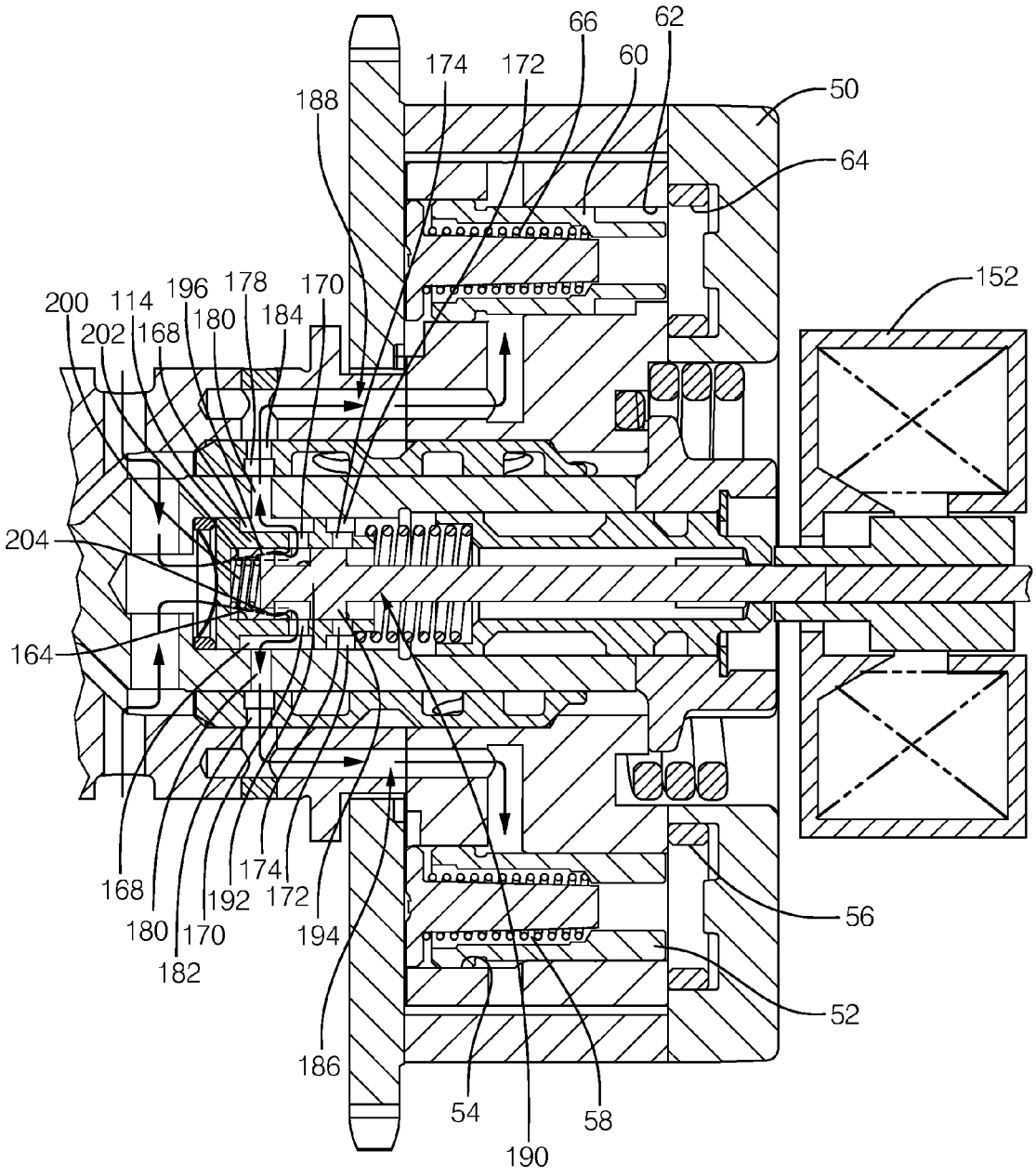
FIG. 3A is an axial cross section of the camshaft phaser showing a lock pin control valve in a first position for supplying pressurized oil to lock pins of the camshaft phaser for retracting the lock pins from their lock pin seats.
Figure 3A:
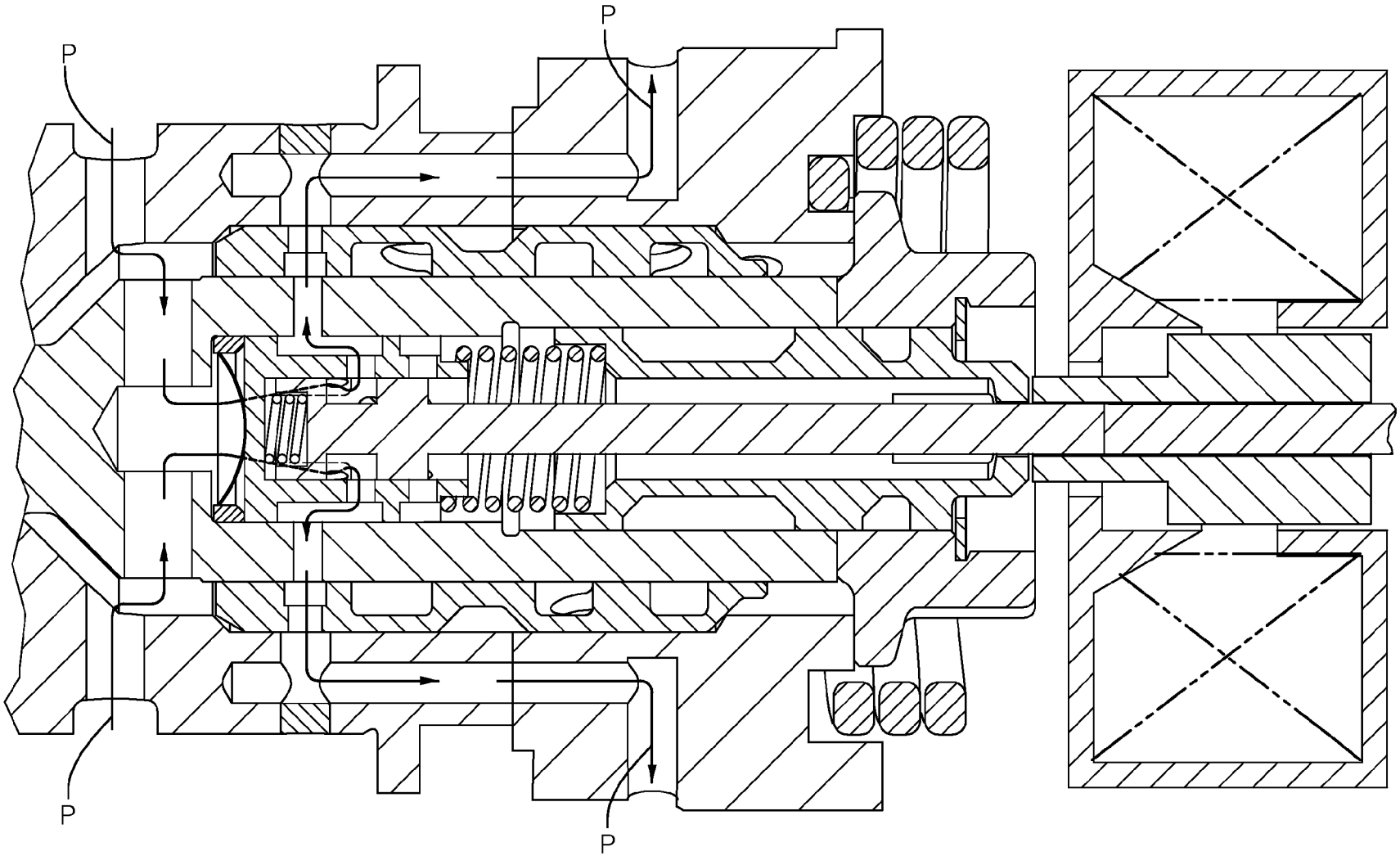
Figure 3B:
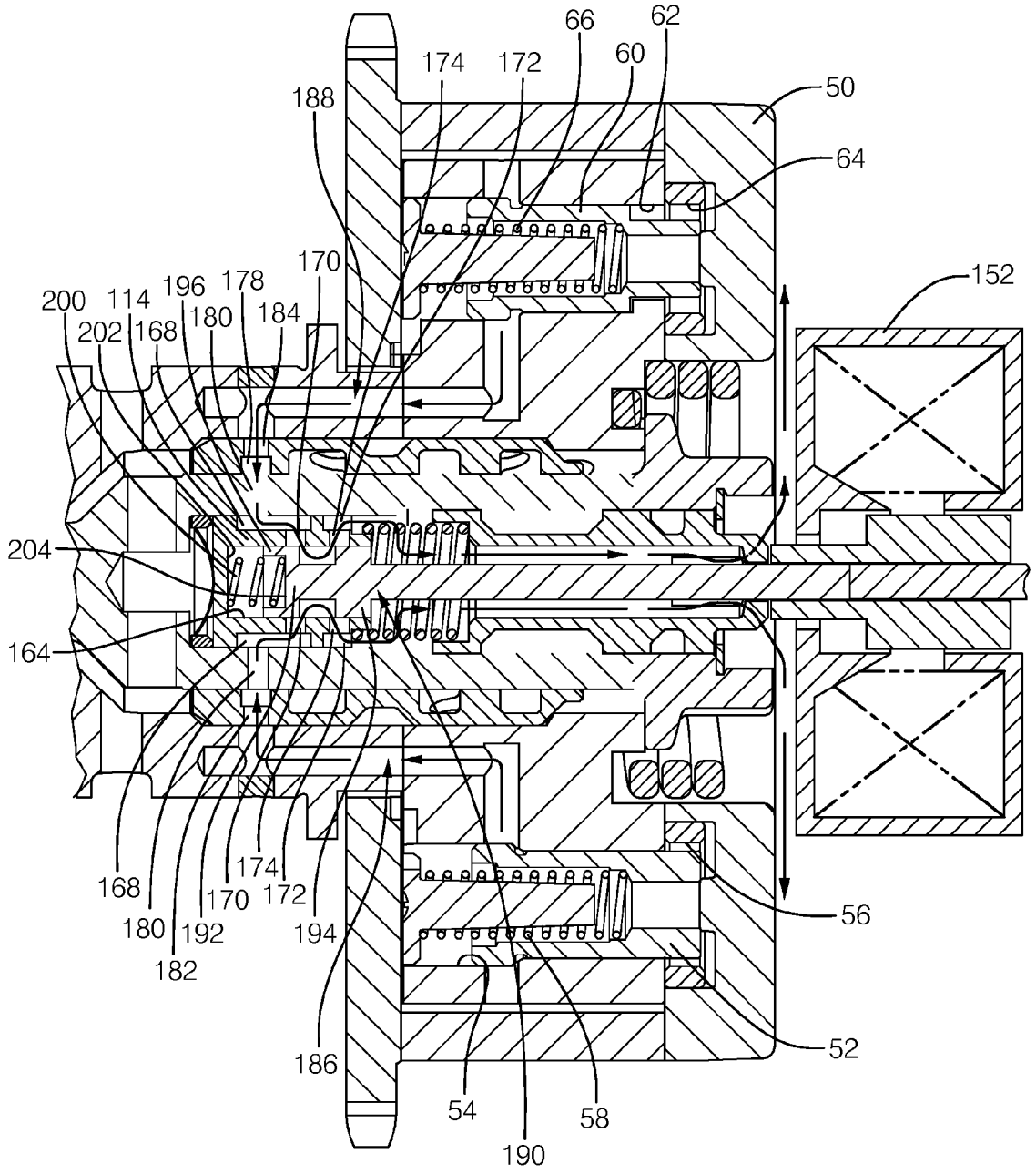
FIG. 3B is an axial cross section of the camshaft phaser showing the lock pin control valve in a second position for vented oil from the lock pins for seating the lock pins in their lock pin seats.
Figure 3B:
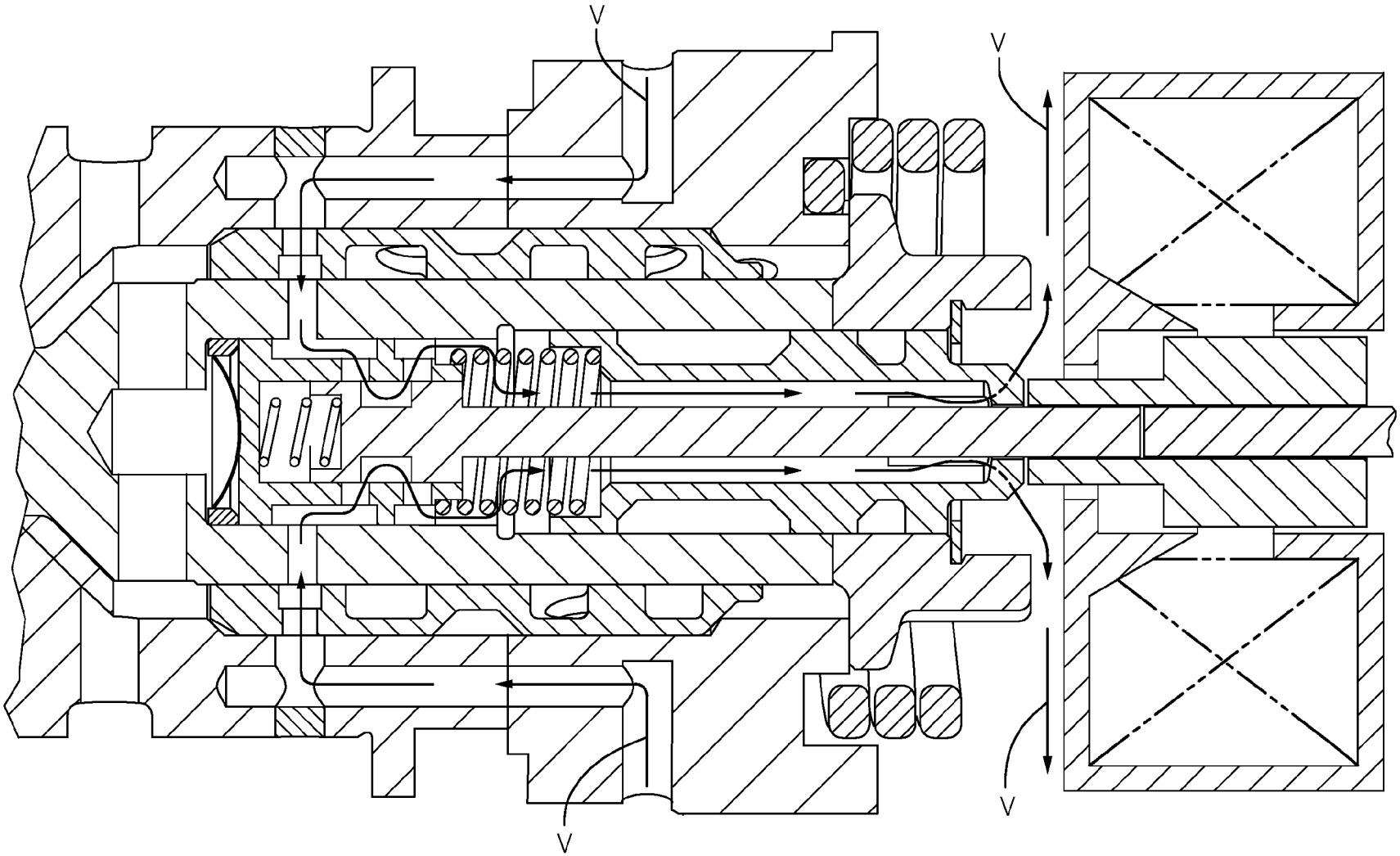

Now referring to FIGS. 1, 3A, and 3B; camshaft phaser 12 includes a staged dual lock pin system for selectively preventing relative rotation between rotor 28 and stator 20 at the predetermined angular position which is between the extreme advance and extreme retard positions. Primary lock pin 52 is slidably disposed within primary lock pin bore 54 formed in one of the plurality of vanes 32 of rotor 28. Primary lock pin seat 56 is formed in camshaft phaser cover 50 for selectively receiving primary lock pin 52 therewithin. Primary lock pin seat 56 is larger than primary lock pin 52 to allow rotor 28 to rotate relative to stator 20 about 5° on each side of the predetermined angular position when primary lock pin 52 is seated within primary lock pin seat 56. The enlarged nature of primary lock pin seat 56 allows primary lock pin 52 to be easily received therewithin. When primary lock pin 52 is not desired to be seated within primary lock pin seat 56 as shown in FIG. 3A, pressurized oil is supplied to primary lock pin 52, thereby urging primary lock pin 52 out of primary lock pin seat 56 and compressing primary lock pin spring 58. Conversely, when primary lock pin 52 is desired to be seated within primary lock pin seat 56 as shown in FIG. 3B, the pressurized oil is vented from primary lock pin 52, thereby allowing primary lock pin spring 58 to urge primary lock pin 52 toward camshaft phaser cover 50. In this way, primary lock pin 52 is seated within primary lock pin seat 56 by primary lock pin spring 58 when rotor 28 is positioned within stator 20 to allow alignment of primary lock pin 52 with primary lock pin seat 56.

Secondary lock pin 60 is slidably disposed within secondary lock pin bore 62 formed in one of the plurality of vanes 32 of rotor 28. Secondary lock pin seat 64 is formed in camshaft phaser cover 50 for selectively receiving secondary lock pin 60 therewithin. Secondary lock pin 60 fits within secondary lock pin seat 64 in a close sliding relationship, thereby substantially preventing relative rotation between rotor 28 and stator 20 when secondary lock pin 60 is received within secondary lock pin seat 64. When secondary lock pin 60 is not desired to be seated within secondary lock pin seat 64 as shown in FIG. 3A, pressurized oil is supplied to secondary lock pin 60, thereby urging secondary lock pin 60 out of secondary lock pin seat 64 and compressing secondary lock pin spring 66. Conversely, when secondary lock pin 60 is desired to be seated within secondary lock pin seat 64 as shown in FIG. 3B, the pressurized oil is vented from the secondary lock pin 60, thereby allowing secondary lock pin spring 66 to urge secondary lock pin 60 toward camshaft phaser cover 50. In this way, secondary lock pin 60 is seated within secondary lock pin seat 64 by secondary lock pin spring 66 when rotor 28 is positioned within stator 20 to allow alignment of secondary lock pin 60 with secondary lock pin seat 64.

When it is desired to prevent relative rotation between rotor 28 and stator 20 at the predetermined angular position, the pressurized oil is vented from both primary lock pin 52 and secondary lock pin 60, thereby allowing primary lock pin spring 58 and secondary lock pin spring 66 to urge primary and secondary lock pins 52, 60 toward camshaft phaser cover 50 respectively. In order to align primary and secondary lock pins 52, 60 with primary and secondary lock pin seats 56, 64 respectively, rotor 28 may be rotated with respect to stator 20 by one or more of supplying pressurized oil to advance chambers 36, supplying pressurized oil to retard chambers 38, urging from bias spring 44, and torque from camshaft 14. Since primary lock pin seat 56 is enlarged, primary lock pin 52 will be seated within primary lock pin seat 56 before secondary lock pin 60 is seated within secondary lock pin seat 64. With primary lock pin 52 seated within primary lock pin seat 56, rotor 28 is allowed to rotate with respect to stator 20 by about 10°. Rotor 28 may be further rotated with respect to stator 20 by one or more of supplying pressurized oil to advance chambers 36, supplying pressurized oil to retard chambers 38, urging from bias spring 44, and torque from camshaft 14 in order to align secondary lock pin 60 with secondary lock pin seat 64, thereby allowing secondary lock pin 60 to be seated within secondary lock pin seat 64. Supply and venting of oil to and from advance chambers 36, retard chambers 38, and primary and secondary lock pins 52, 60 will be described in more detail later.

Now referring to FIGS. 1 and 2A, camshaft phaser cover 50 is sealingly attached to stator 20 by sprocket bolts 22 that extend through sprocket 16 and stator 20 and threadably engage camshaft phaser cover 50. In this way, stator 20 is securely clamped between sprocket 16 and camshaft phaser cover 50 in order to axially and radially secure sprocket 16, stator 20, and camshaft cover 50 to each other.

Now referring to FIGS. 1, 2A, 2B, 2C, 6A, and 6B; bushing adaptor 68 is coaxially disposed within pocket 70 of camshaft 14 in a close fitting relationship. Bushing adaptor 68 is also coaxially disposed within central through bore 34 of rotor 28 in a press fit relationship to prevent relative rotation therebetween and may be press fit within central through bore 34 until bushing adaptor 68 abuts stop surface 72 formed by the stepped nature of central through bore 34. When camshaft phaser 12 is attached to camshaft 14, bushing adaptor 68 coaxially aligns camshaft phaser 12 with camshaft 14. This allows the rotor 28 to be made more axially compact because axial space is not needed within rotor 28 for receiving camshaft 14 therewithin in order to coaxially align camshaft phaser 12 with camshaft 14. A network of oil passages is defined in part by bushing adaptor 68 in a way that will be described in detail later.

Camshaft phaser 12 is attached to camshaft 14 with camshaft phaser attachment bolt 74 which extends axially through bushing adaptor 68 in a close fitting relationship. Rotor 28 is positioned against axial face 76 of camshaft 14 which is provided with threaded hole 78 extending axially into camshaft 14 from pocket 70.

Annular oil chamber 80 is formed radially between camshaft phaser attachment bolt 74 and pocket 70 for receiving oil from camshaft oil passages 82 formed radially through camshaft 14. Oil is supplied to camshaft oil passages 82 from internal combustion engine 10 through an oil gallery (not shown) in camshaft bearing 84. When camshaft phaser attachment bolt 74 is tightened to a predetermined torque, head 86 of camshaft phaser attachment bolt 74 acts axially on bolt surface 88 of rotor 28. In this way, camshaft phaser 12 is axially secured to camshaft 14 and relative rotation between rotor 28 and camshaft 14 is thereby prevented.

Bushing adaptor 68 defines at least in part supply passage 90 for communicating pressurized oil from internal combustion engine 10 to phase relationship control valve 92. Supply passage 90 may be defined in part by first annular groove 94 formed on the inside diameter of bushing adaptor 68. First annular groove 94 may be positioned axially within rotor 28.

Supply passage 90 may be further defined by axial grooves 96 which extend axially part way into central through bore 34 of rotor 28. Axial grooves 96 may be in fluid communication with first annular groove 94 through first connecting passages 98 which extend radially through bushing adaptor 68.

Supply passage 90 may be further defined by second annular groove 100 formed on the inside diameter of bushing adaptor 68 and which may be positioned axially within pocket 70 of camshaft 14. Second annular groove 100 may be in fluid communication with axial grooves 96 through second connecting passages 102 which extend radially through bushing adaptor 68.

Supply passage 90 may be further defined by third annular groove 104 formed on the outside diameter of bushing adaptor 68 and axially between first annular groove 94 and second annular groove 100. Third annular groove 104 may be in fluid communication with second annular groove 100 through second connecting passages 102 and may also be in fluid communication with axial grooves 96 by axially positioning third annular groove 104 on the outside diameter of bushing adaptor 68 such that axial grooves 96 at least partly overlap axially with third annular groove 104.

Supply passage 90 may be further defined by blind bore 106 formed axially within camshaft phaser attachment bolt 74. Blind bore 106 begins at the end of camshaft phaser attachment bolt 74 defined by head 86 and may extend to a point within camshaft phaser attachment bolt 74 that is axially aligned with annular oil chamber 80. First radial drillings 108 extend radially through camshaft phaser attachment bolt 74 and provide fluid communication from annular oil chamber 80 to blind bore 106 while second radial drillings 110 are spaced axially apart from first radial drillings 108 and extend radially through camshaft phaser attachment bolt 74 to provide fluid communication from blind bore 106 to second annular groove 100.

Now referring to FIGS. 1, 2A, 2B, 2C, and 5A-5D; supply passage 90 may be further defined by manifold axial grooves 112 of manifold 114 which is press fit into blind bore 106. Manifold axial grooves 112 are formed in the outer surface of manifold 114 and begin at an end of manifold 114 proximal to first radial drillings 108 and extend to overlap with second radial drillings 110. Each manifold axial groove 112 is aligned with and overlaps one second radial drilling 110. Other features and functions of manifold 114 will be described later in more detail.

Filter 116 may be captured in blind bore 106 between manifold 114 and shoulder 118 formed in blind bore 106. Filter 116 substantially prevents foreign matter that may be present in the pressurized oil from being communicated to manifold axial grooves 112 and subsequently to other critical interfaces of camshaft phaser 12.

Camshaft phaser attachment bolt 74 includes supply drillings 120 extending radially therethrough for providing fluid communication between first annular groove 94 and blind bore 106. Supply drillings 120 allow pressurized oil to be supplied to phase relationship control valve 92.

Now referring to FIGS. 1, 2A, 2B, 6A, and 6B; in addition to defining at least in part supply passage 90, bushing adaptor 68, also defines at least in part advance passage 122 for selectively communicating pressurized oil from phase relationship control valve 92 to advance chambers 36 and for venting oil therefrom. Advance passage 122 may be defined at least in part by fourth annular groove 124 formed on the inside diameter of bushing adaptor 68 and axially between first annular groove 94 and second annular groove 100. Through advance oil connecting passages 126, fourth annular groove 124 is in fluid communication with oil passages 42A that are in fluid communication advance chambers 36. Advance oil connecting passages 126 extend radially from fourth annular groove 124 through bushing adaptor 68.

Camshaft phaser attachment bolt 74 includes advance drillings 128 extending radially therethrough for providing fluid communication between fourth annular groove 124 and blind bore 106. Advance drillings 128 allow pressurized oil to be selectively supplied from phase relationship control valve 92 to advance chambers 36.

In addition to defining at least in part supply passage 90 and advance passage 122, bushing adaptor 68 also defines at least in part retard passage 130 for selectively communicating pressurized oil from phase relationship control valve 92 to retard chambers 38. Retard passage 130 may be defined by axial space 132 formed axially between axial end 134 and head 86. Axial end 134 may be defined by reduced diameter section 136 which provides radial clearance between central through bore 34 of rotor 28 and reduced diameter section 136. Axial space 132 is further defined radially between rotor 28 and camshaft phaser attachment bolt 74. Axial space 132 is in fluid communication with oil passages 42R that are in fluid communication with retard chambers 38.

Camshaft phaser attachment bolt 74 includes retard drillings 138 extending radially through camshaft phaser attachment bolt 74 for providing fluid communication between axial space 132 and blind bore 106. Retard drillings 138 allow pressurized oil to be selectively supplied from phase relationship control valve 92 to retard chambers 38.

Phase relationship control valve 92 is disposed within camshaft phaser attachment bolt 74 and retained therein by retaining ring 140 which fits within groove 142 of camshaft phaser attachment bolt 74. Phase relationship control valve 92 includes phase relationship valve spool 144 with phase relationship body 146 that is generally cylindrical, hollow and dimensioned to provide annular clearance between phase relationship body 146 and blind bore 106 of camshaft phaser attachment bolt 74.

Phase relationship valve spool 144 also includes advance land 148 extending radially outward from phase relationship body 146 for selectively blocking fluid communication between supply drillings 120 and advance drillings 128. Advance land 148 fits within blind bore 106 of camshaft phaser attachment bolt 74 in a close fitting relationship to substantially prevent oil from passing between advance land 148 and blind bore 106.

Phase relationship valve spool 144 also includes retard land 150 extending radially outward from phase relationship body 146 for selectively blocking fluid communication between supply drillings 120 and retard drillings 138. Retard land 150 is positioned axially away from advance land 148 and fits within blind bore 106 of camshaft phaser attachment bolt 74 in a close fitting relationship to substantially prevent oil from passing between retard land 150 and blind bore 106.

Figure 2B:
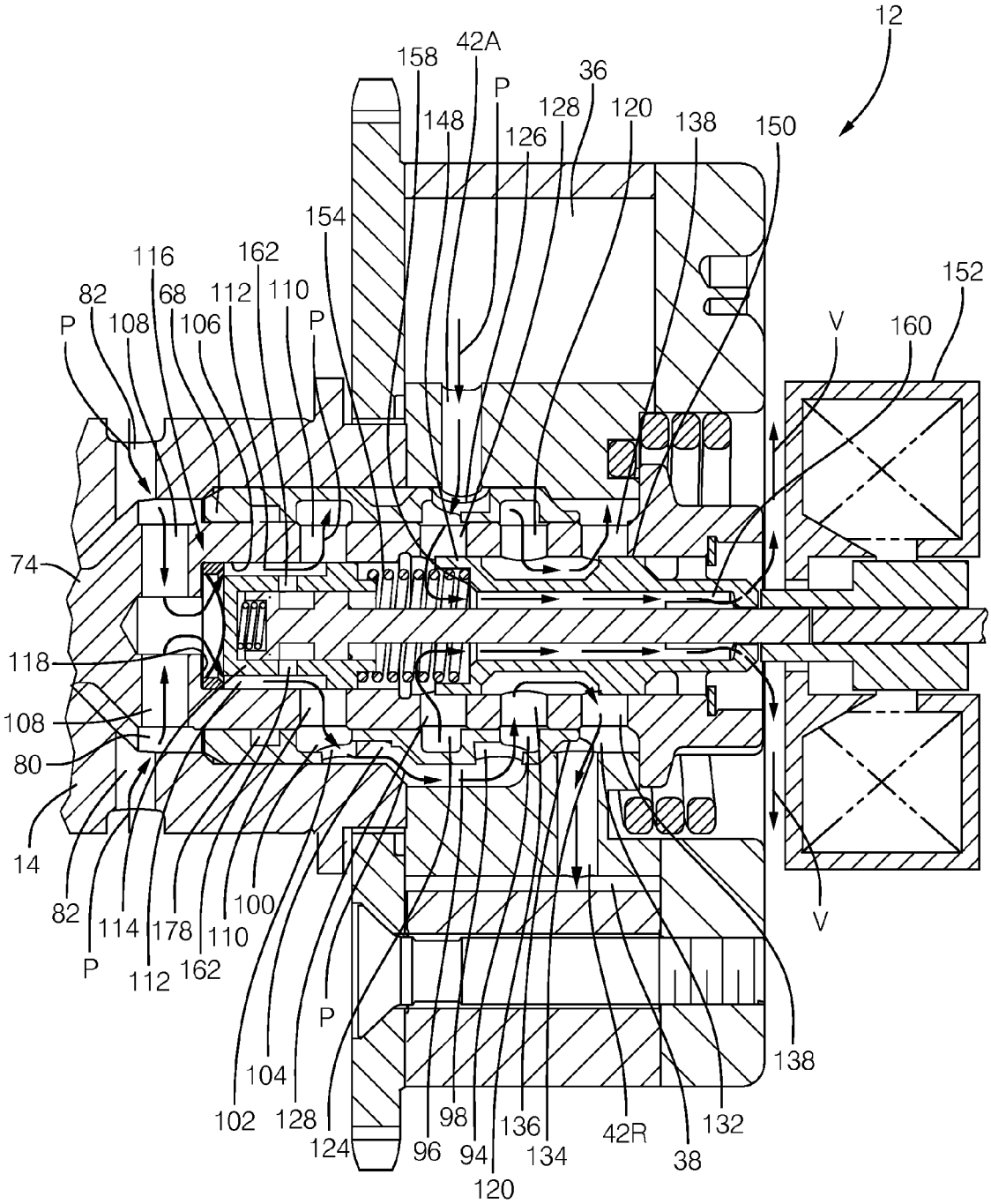
FIG. 2B is the axial cross-section of FIG. 2A showing a phase relationship control valve in a first position for supplying pressurized oil to retard chambers of the camshaft phaser and for venting oil from the advance chambers the camshaft phaser.
Figure 2B:
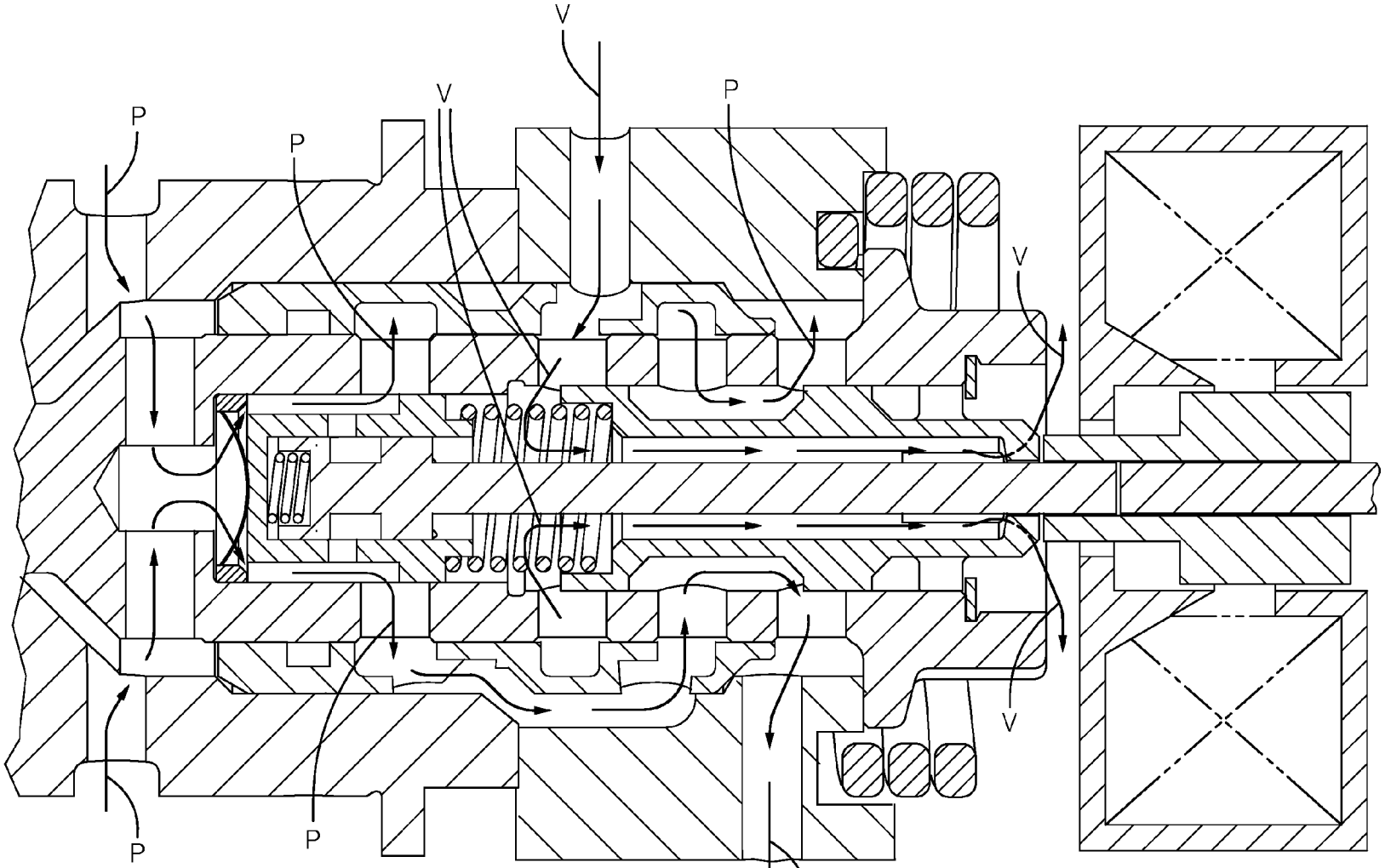
Figure 2C:
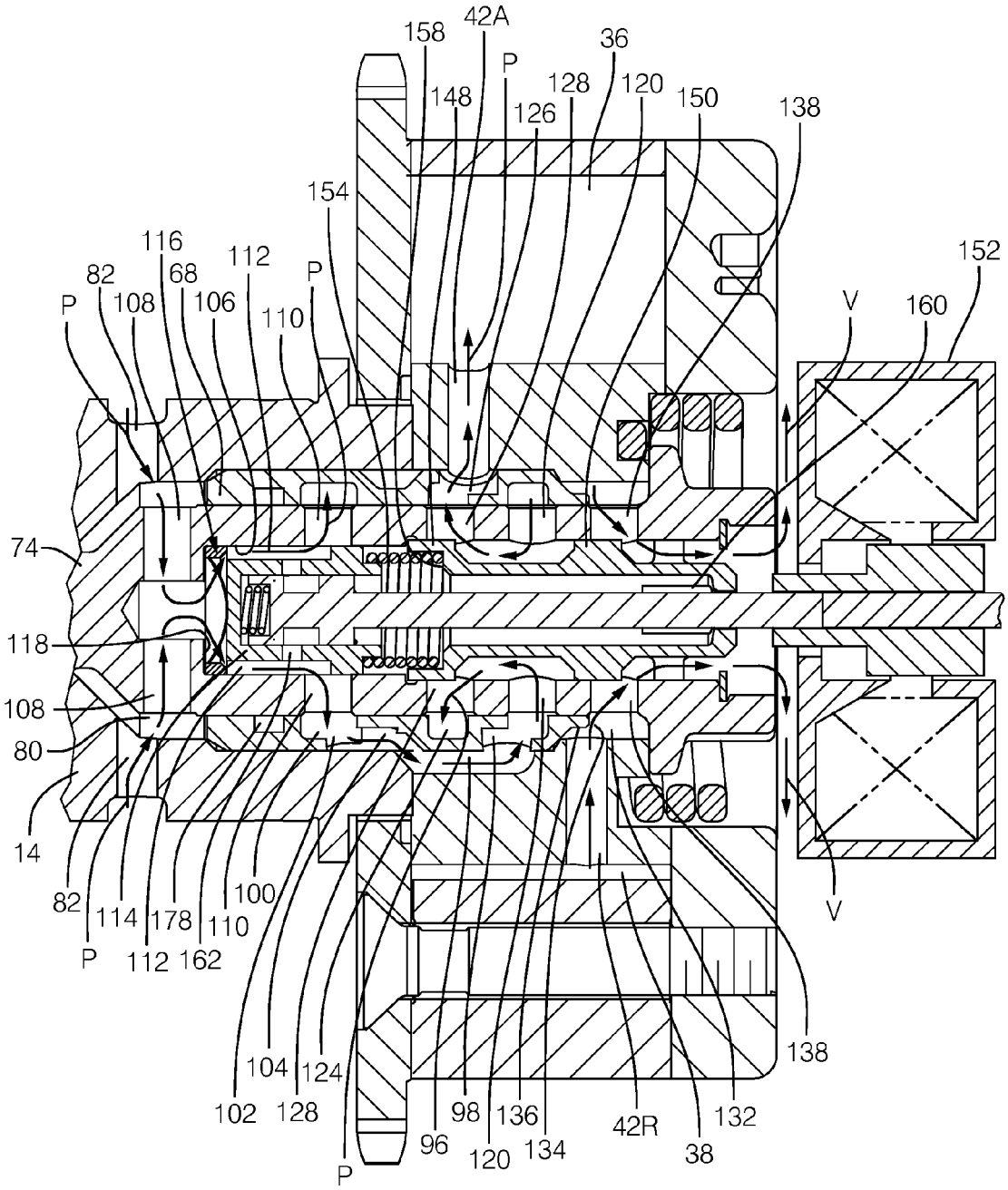
FIG. 2C is the axial cross section of FIG. 2A showing the phase relationship control valve in a second position for supplying pressurized oil to the advance chambers and for venting oil from the retard chambers.
Figure 2C:
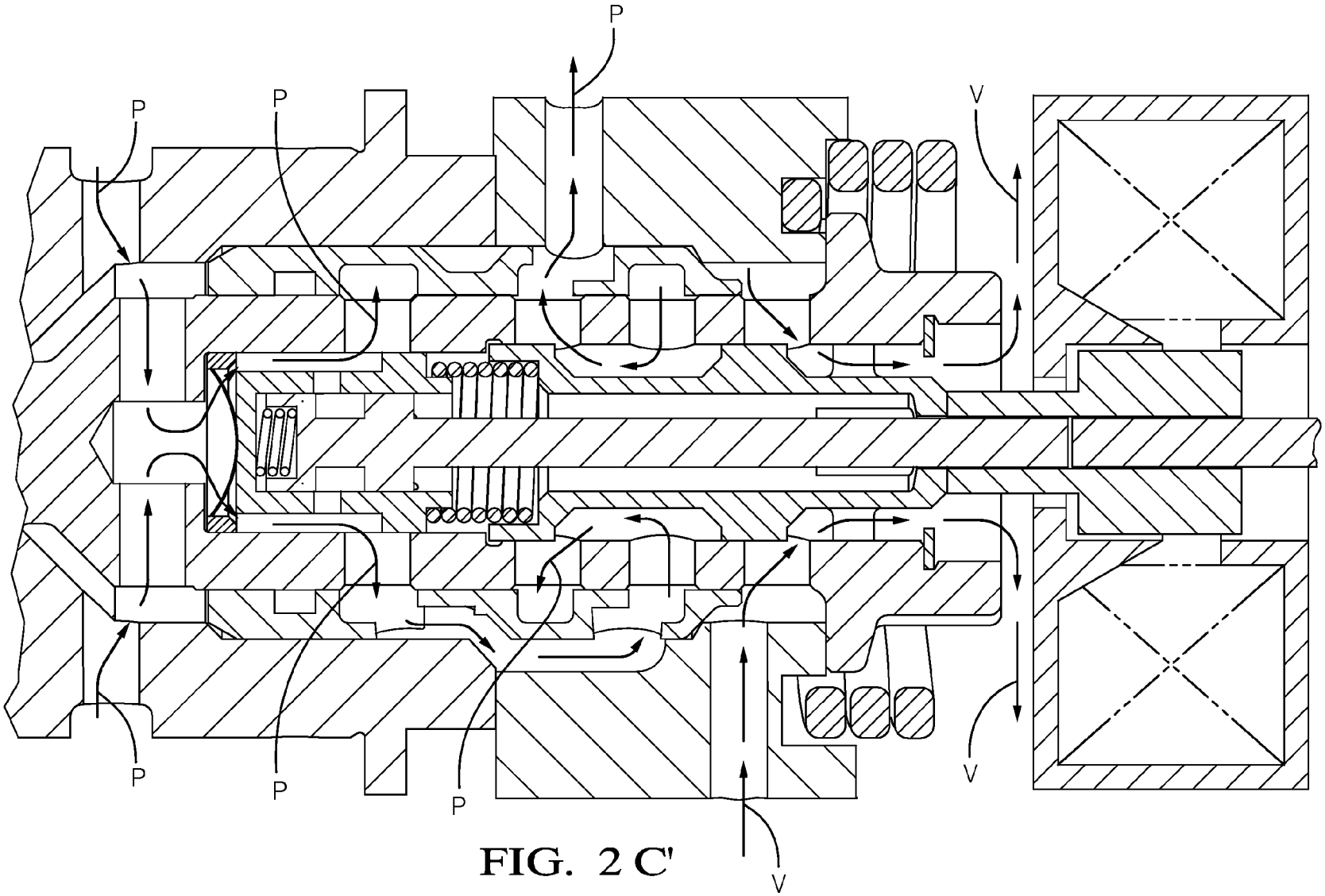

Now referring to FIGS. 1, 2A, 2B, and 2C; phase relationship valve spool 144 is axially moveable within blind bore 106 with input from phase relationship control valve actuator 152 and phase relationship spool spring 154. Phase relationship control valve actuator 152 is preferably an electrically actuated solenoid, but may be any type of actuator for axially moving phase relationship valve spool 144. Phase relationship spool spring 154 is grounded to camshaft phaser attachment bolt 74 by seat 156 which is formed on the end of manifold 114 distal from first radial drillings 108. A first end of phase relationship spool spring 154 is seated on seat 156 while a second end of phase relationship spool spring 154 is seated within phase relationship spool spring pocket 158 formed in an end of phase relationship valve spool 144. In this way as shown in FIG. 2B, phase relationship spool spring 154 biases phase relationship valve spool 144 away from seat 156 when phase relationship control valve actuator 152 is not energized, thereby positioning phase relationship valve spool 144 within blind bore 106 such that pressurized oil is supplied to retard drillings 138 from supply drillings 120 while oil is vented from advance drillings 128 through central passage 160 of phase relationship valve spool 144 and through the end of blind bore 106 that is adjacent to head 86. In contrast as shown in FIG. 2C, when phase relationship control valve actuator 152 is energized, the biasing force of phase relationship spool spring 154 is overcome to position phase relationship valve spool 144 within blind bore 106 such that pressurized oil is supplied to advance drillings 128 while oil is vented from retard drillings 138 to the end of blind bore 106 that is adjacent to head 86.

Now referring to FIGS. 1, 2A, 2B, 3A, 3B, and 5A-5D; the function and additional features of manifold 114 will now be described. Manifold 114 is cylindrical and hollow and is included to provide passages for selectively supplying pressurized oil to primary and secondary lock pins 52, 60 for removing primary and secondary lock pins 52, 60 from primary and secondary lock pin seats 56, 64 respectively. Manifold 114 is also included to provide passages for selectively venting oil from primary and secondary lock pins 52, 60 for seating primary and secondary lock pins 52, 60 from primary and secondary lock pin seats 56, 64 respectively.

Manifold supply connecting passages 162 extend radially through manifold 114 in order to provide fluid communication from manifold axial grooves 112 to manifold central bore 164 which contains lock pin control valve 166 in a close fit sliding relationship.

Manifold 114 also includes blind axial grooves 168 for selectively supplying pressurized oil to primary and secondary lock pins 52, 60 and for selectively venting oil from primary and secondary lock pins 52, 60. Blind axial groves 168 extend axially on the outer circumference of manifold 114 and are not open to either the end of manifold 114 proximal to first radial drillings 108 or the end of manifold 114 distal from first radial drillings 108. Lock pin connecting passages 170 (shown as hidden lines in FIGS. 5A-5D) extend radially through manifold 114 to provide fluid communication between manifold central bore 164 and blind axial grooves 168.

Manifold 114 also includes vent grooves 172 for communicating oil from manifold central bore 164 that has been vented from primary and secondary lock pins 52, 60. Vent grooves 172 are located in the outer circumference of manifold 114 and extend axially into manifold 114 from the end of manifold 114 that is distal from first radial drillings 108. Vent connecting passages 174 extend radially through manifold 114 to provide fluid communication between manifold central bore 164 and vent grooves 172. Vent connecting passages 174 are spaced axially away from lock pin connecting passages 170 in the direction toward the end of manifold 114 that is distal from first radial drillings 108. One of the vent grooves 172 extends axially further than the other vent grooves 172 and includes auxiliary vent connecting passage 176 to provide fluid communication between manifold central bore and vent groove 172 as shown best in FIGS. 5C and 5D. Auxiliary vent connecting passage 176 is spaced axially away from lock pin connecting passages 170 and manifold supply connecting passages 162 in the direction toward the end of manifold 114 that is proximal to first radial drillings 108. The function of auxiliary vent connecting passage 176 will be discussed in more detail later.

Now referring to FIGS. 1, 2A, 2B, 3A, 3B, 6A, and 6B; bushing adaptor 68 includes fifth annular groove 178 formed on the inside diameter thereof. Fifth annular groove 178 is axially aligned with lock pin drillings 180 that extend radially through camshaft phaser attachment bolt 74 as best shown in FIGS. 3A and 3B. Each lock pin drilling 180 is aligned with and is in fluid communication with one blind axial groove 168. In this way, each blind axial groove 168 is in fluid communication with fifth annular groove 178.

Primary lock pin drilling 182 and secondary lock pin drilling 184 extend from fifth annular groove 178 radially through bushing adaptor 68. Primary lock pin drilling 182 is in fluid communication with primary lock pin passage 186 that extends through camshaft 14 and rotor 28 for supplying pressurized oil to primary lock pin 52 and for venting oil from primary lock pin 52. Similarly, secondary lock pin drilling 184 is in fluid communication with secondary lock pin passage 188 that extends through camshaft 14 and rotor 28 for supplying pressurized oil to primary lock pin 52 and for venting oil from primary lock pin 52.

Lock pin control valve 166 includes lock pin valve spool 190 with lock pin valve spool body 192 that is generally cylindrical and dimensioned to provide annular clearance between lock pin valve spool body 192 and manifold central bore 164.

Lock pin control valve 166 also includes vent land 194 extending radially outward from lock pin valve spool body 192 for selectively blocking fluid communication between manifold central bore 164 and vent grooves 172 through vent connecting passages 174 as shown in FIG. 3A. Vent land 194 fits within manifold central bore 164 in a close fitting relationship to substantially prevent oil from passing between vent land 194 and manifold central bore 164.

Lock pin control valve 166 also includes supply land 196 extending radially outward from lock pin valve spool body 192 for selectively blocking fluid communication between manifold central bore 164 and blind axial grooves 168 through manifold supply connecting passages 162. Supply land 196 fits within manifold central bore 164 in a close fitting relationship to substantially prevent oil from passing between supply land 196 and manifold central bore 164.

Lock pin control valve 166 is axially moveable within manifold central bore 164 with input from lock pin control valve actuator 198 and lock pin valve spool spring 200. Lock pin control valve actuator 198 is preferably an electrically actuated solenoid, but may be any type of actuator for axially moving lock pin control valve 166. Lock pin valve spool spring 200 is grounded to closed end 202 of manifold 114 which gives manifold 114 a cup-shaped cross-sectional shape. A first end of lock pin valve spool spring 200 is seated against closed end 202 while a second end of lock pin valve spool spring 200 is seated within spring recess 204 formed in the end of lock pin valve spool 190 proximal to closed end 202 as best shown in FIG. 3B. In this way, lock pin valve spool spring 200 biases lock pin valve spool 190 away from closed end 202 when lock pin control valve actuator 198 is not energized, thereby positioning lock pin valve spool 190 within manifold central bore 164 such that supply land 196 blocks pressurized oil from entering manifold central bore through manifold supply connecting passages 162 while oil is allowed to vent to vent grooves 172 from primary and secondary lock pins 52, 60 through vent connecting passages 174 which are in fluid communication with manifold central bore 164, lock pin connecting passages 170, blind axial grooves 168, lock pin drillings 180, fifth annular groove 178, and primary and secondary lock pin passages 186, 188. When lock pin control valve actuator 198 is not energized as shown in FIG. 3B, auxiliary vent connecting passage 176 is in fluid communication with manifold central bore 164. In this way, the volume defined between closed end 202 and spring recess 204 is vented to prevent a sealed chamber from being formed that would require added force from lock pin control valve actuator 198 to compress a volume of air when actuated. In contrast, when lock pin control valve actuator 198 is energized as shown in FIG. 3A, the biasing force of lock pin valve spool spring 200 is overcome to position lock pin valve spool 190 within manifold central bore 164 such that pressurized oil is allowed to be communicated to primary and secondary lock pins 52, 60 through manifold supply connecting passages 162 (not visible in FIG. 3A), manifold central bore 164, lock pin connecting passages 170, blind axial grooves 168, lock pin drillings 180, fifth annular groove 178, and primary and secondary lock pin drillings 182, 184 while vent land 194 blocks vent connecting passages 174. When lock pin control valve actuator 198 is energized, auxiliary vent connecting passage 176 is blocked by supply land 196 to prevent fluid communication between manifold central bore 164 and vent groove 172 through auxiliary vent connecting passage 176.

In operation and referring to FIGS. 2A, 2B, 3A, 3A', 3B, and 3B'; when a change in phase relationship between camshaft 14 and the crankshaft of internal combustion engine 10 is desired, pressurized oil from internal combustion engine 10 is supplied to primary and secondary lock pins 52, 60 where the path taken by the pressurized oil is represented by arrows P. This is accomplished by energizing lock pin control valve actuator 198 to prevent fluid communication from blind axial grooves 168 to vent connecting passages 174, to block auxiliary vent connecting passage 176, and to allow fluid communication from manifold axial grooves 112 to manifold supply connecting passages 162. In this way, pressurized oil from internal combustion engine 10 is supplied to annular oil chamber 80 through camshaft oil passages 82. From annular oil chamber 80, the pressurized oil is supplied to blind bore 106 through first radial drillings 108. The pressurized oil is then passed through filter 116 before reaching manifold axial grooves 112. Oil flow through this area is shown as hidden lines in FIGS. 3A and 3A' because manifold axial grooves 112 are not visible in FIGS. 3A, 3A', 3B, and 3B'. The pressurized oil then passes through manifold supply connecting passages 162 (also not visible in FIGS. 3A, 3A', 3B, and 3B') to reach manifold central bore 164. After reaching manifold central bore 164, the pressurized oil passes through lock pin connecting passages 170 to reach blind axial grooves 168. The pressurized oil then passes through lock pin drillings 180 which supply the pressurized oil to fifth annular groove 178. Fifth annular groove 178 subsequently supplies pressurized oil to primary and secondary lock pin drillings 182 and 184 which cause primary and secondary lock pins 52, 60 to retract from primary and secondary lock pin seats 56, 64 respectively. For clarity, FIG. 3A' is provided without reference numbers and without elements that do not define the oil passages to clearly show the path taken by the pressurized oil as represented by arrows P.

Now referring to FIGS. 2A, 2B, 2B', 2C, and 2C'; with primary and secondary lock pins 52, 60 now retracted from primary and secondary lock pin seats 56, 64 respectively, the phase relationship between camshaft 14 and the crankshaft of internal combustion engine 10 can now be altered. This is accomplished by supplying pressurized oil to either the advance chambers 36 or to the retard chambers 38 while oil is vented from the chambers that are not receiving pressurized oil. A portion of the pressurized oil that is supplied to manifold axial grooves 112 passes through second radial drillings 110 to supply the pressurized oil to second annular groove 100. The pressurized oil is then communicated to third annular groove 104 through second connecting passages 102 which then communicate the pressurized oil to axial grooves 96. The pressurize is then supplied to first annular groove 94 through first connecting passages 98 before being supplied to phase relationship control valve 92 through supply drillings 120.

If the pressurized oil is desired to be supplied to retard chambers 38, phase relationship control valve actuator 152 is placed in an unenergized state of operation. In this state of operation and as shown in FIG. 2C, phase relationship valve spool 144 is positioned within blind bore 106 to allow the pressurized oil to be communicated to retard drillings 138 from first connecting passages 98 where the path taken by the pressurized oil is represented by arrows P. Retard drillings 138 then communicate the pressurized oil to axial space 132 where the pressurized oil is then communicated to retard chambers 38 through oil passages 42R.

At the same time, the pressurized oil is prevented from being communicated from first connecting passages 98 to advance drillings 128 by advance land 148. Also at the same time, advance land 148 allows the oil to be vented from advance chambers 36 by placing advance drillings 128 in fluid communication with central passage 160 where the path taken by the vented oil is represented by arrows V. In this way, oil is allowed to be vented from advance chambers 36 through oil passages 42A. The vented oil then passes from oil passages 42A to fourth annular groove 124 through advance oil connecting passages 126. The oil is then communicated to central passage 160 through advance drillings where the oil is then vented through the end of camshaft phaser attachment bolt 74. Oil communicated through the end of camshaft phaser attachment bolt 74 is shown as hidden lines because the passages therethrough are not visible in this view. For clarity, FIG. 2B' is provided without reference numbers and without elements that do not define the oil passages to clearly show the path taken by the pressurized oil represented by arrows P and the path taken by the vented oil represented by arrows V.

However, if the pressurized oil is desired to be supplied to advance chambers 36, phase relationship control valve actuator 152 is placed in an energized state of operation. In this state of operation as shown in FIG. 2C, phase relationship valve spool 144 is positioned within blind bore 106 to allow the pressurized oil to be communicated to advance drillings 128 from first connecting passages 98 where the path taken by the pressurized oil is represented by arrows P. Advance drillings 128 then communicate the pressurized oil to fourth annular groove 124 where the pressurized oil is then communicated to advance chambers 36 through advance oil connecting passages 126 and oil passages 42A.

At the same time, the pressurized oil is prevented from being communicated from first connecting passages 98 to retard drillings 138 by retard land 150. Also at the same time, retard land 150 allows the oil to be vented from retard chambers 38 by placing retard drillings 138 in fluid communication with central passage 160 where the path taken by the vented oil is represented by arrows V. In this way, oil is allowed to be vented from retard chambers 38 through oil passages 42R. The vented oil then passes from oil passages 42R to axial space 132 and then through retard drillings 138 and out the end of camshaft phaser attachment bolt 74. For clarity, FIG. 2C' is provided without reference numbers and without elements that do not define the oil passages to clearly show the path taken by the pressurized oil represented by arrows P and the path taken by the vented oil represented by arrows V.

In operation and referring to FIGS. 2A and 3B, when it is desired to lock rotor 28 at the predetermined angular position with respect to stator 20, oil is vented from primary and secondary lock pins 52, 60 in order to seat primary and secondary lock pins 52, 60 within primary and secondary lock pin seats 56, 64 respectively. This is accomplished by placing lock pin control valve actuator in an unenergized state of operation. In the unenergized state of operation, lock pin valve spool 190 is positioned within manifold central bore 164 to prevent fluid communication between manifold supply connecting passages 162 and lock pin connecting passages 170 with supply land 196. In this way, pressurized oil is prevented from being supplied to primary and secondary lock pins 52, 60.

At the same time, vent land 194 no longer blocks vent connecting passages 174 and auxiliary vent connecting passage 176, and as a result, lock pin connecting passage 170 is now in fluid communication with vent connecting passage 174. In this way, the oil is vented from primary and secondary lock pins 52, 60 through primary and secondary lock pin passages 186, 188 where the path taken by the vented oil is represented by arrows V. The oil from primary and secondary lock pin passages 186, 188 is then passed to fifth annular groove 178 through primary and secondary lock pin drillings 182, 184 respectively before being communicated to blind axial grooves 168 through lock pin drillings 180. The oil is then communicated from blind axial grooves 168 to manifold central bore 164 through lock pin connecting passages 170 before being communicated to vent grooves 172 through vent connecting passages 174. The oil is then vented through the end of camshaft phaser attachment bolt 74 by passing through central passage 160. Oil communicated through the end of camshaft phaser attachment bolt 74 is shown as hidden lines because the passages therethrough are not visible in this view. For clarity, FIG. 3B' is provided without reference numbers and without elements that do not define the oil passages to clearly show the path taken by the vented oil represented by arrows V.

With the oil vented from primary and secondary lock pins 52, 60, primary and secondary lock pin springs 58, 66 urge primary and secondary lock pins 52, 60 respectively toward camshaft phaser cover 50. However, unless primary and secondary lock pins 52, 60 are already aligned with primary and secondary lock pin seats 56, 64 respectively, one or both of the primary and secondary lock pins 52, 60 will not be seated within primary and secondary lock pin seats 56, 64 respectively. In order to seat primary and secondary lock pins 52, 60 within primary and secondary lock pin seats 56, 64 respectively, the phase relationship between rotor 28 and stator 20 will need to be altered. This may be accomplished by supplying the pressurized oil to either advance chambers 36 or retard chambers 38 as needed to achieve the predetermined angular relationship of rotor 28 within stator 20. This may also be accomplished by allowing bias spring 44 to urge rotor 28 to the predetermined angular position. Furthermore, this may be accomplished by allowing torque from camshaft 14 to urge rotor 28 to the predetermined angular position. As described earlier, primary lock pin 52 will be seated within primary lock pin seat 56 first thereby holding rotor 28 near the predetermined angular position. Secondary lock pin 60 will then be seated within secondary lock pin seat 64 when secondary lock pin 60 is aligned with secondary lock pin seat 64.

Now referring to FIGS. 7A, 7B, 8A, and 8B; a second embodiment camshaft phaser 12' in accordance with the present invention is shown. Reference numbers of elements used in the description of camshaft phaser 12 will also be used in the description of element of camshaft phaser 12' that are identical to the elements of camshaft phaser 12. The differences of camshaft phaser 12' relative to camshaft phaser 12 will now be described. Rather than using a spool-type valve to control oil being supplied to and from primary and secondary lock pins 52, 60 as camshaft phaser 12 uses, camshaft phaser 12' uses a poppet-type valve to control oil being supplied to and from primary and secondary lock pins 52, 60. In order to implement a poppet-type valve to control oil being supplied to and from primary and secondary lock pins 52, 60, manifold 114' is provided which is press fit within blind bore 106. Manifold 114' includes manifold axial grooves 112 which are formed in the outer surface of manifold 114' and begin an end of manifold 114' proximal to first radial drillings 108 and extend to overlap with second radial drillings 110 (not visible in FIGS. 7A, 7B, 8A, and 8B) of camshaft phaser attachment bolt 74. Each manifold axial groove 112 is aligned with and overlaps one second radial drilling 110 to supply pressurized oil to phase relationship control valve 92 in the same way manifold axial grooves 112 of manifold 114 supply pressurized oil to phase relationship control valve 92 the embodiment of camshaft phaser 12.

Manifold 114' includes manifold central bore 164' that extends axially through manifold 114'. Manifold central bore 164' includes inner annular rib 206 which defines a portion of manifold central bore 164' that is smaller in diameter than the remainder of manifold central bore 164'. Inner annular rib 206 is offset axially from each end of manifold central bore 164' and defines supply seat 208 on the side of manifold 114'proximal to first radial drillings 108. Inner annular rib 206 also defines vent seat 210 on the side of manifold 114' distal to first radial drillings 108.

Lock pin connecting passages 170' extend radially through inner annular rib 206 to provide fluid communication between manifold central bore 164' and blind axial grooves 168. Each blind axial groove 168 is aligned with and is in fluid communication with one lock pin drilling 180 in the same way as in camshaft phaser 12.

Manifold 114' together with ball 212 and plunger 214 define lock pin control valve 166'. Ball 212 is disposed within the side of manifold central bore 164' that is adjacent to supply seat 208. Ball 212 is selectively seated against supply seat 208 by pressurized oil and is selectively unseated from supply seat 208 by plunger 214.

Plunger 214 includes plunger shaft 216 that extends through central passage 160 of phase relationship valve spool 144 and is sized to provide radial clearance therebetween. Plunger shaft 216 also extends coaxially through phase relationship control valve actuator 152. Plunger 214 extends part way through inner annular rib 206 and is sized provide radial clearance therebetween.

Plunger 214 also includes outer annular rib 218 which extends radially outward therefrom. Outer annular rib 218 is sized to provide radial clearance between manifold central bore 164' and to seat against vent seat 210.

Plunger 214 also includes spring stop 220 which extends radially outward from plunger shaft 216. A first end of lock pin valve spring 222 is seated against spring stop 220 while a second end of lock pin valve spring is grounded to plunger guide 224 which is disposed in blind bore 106 adjacent to manifold 114'. Lock pin valve spring 222 biases plunger 214 to unseat outer annular rib 218 from vent seat 210 when lock pin control valve actuator 198 is unenergized. Plunger guide 224 includes axial through holes 226 to provide fluid communication through plunger guide 224 as will be discussed later in more detail.

Figure 7A:
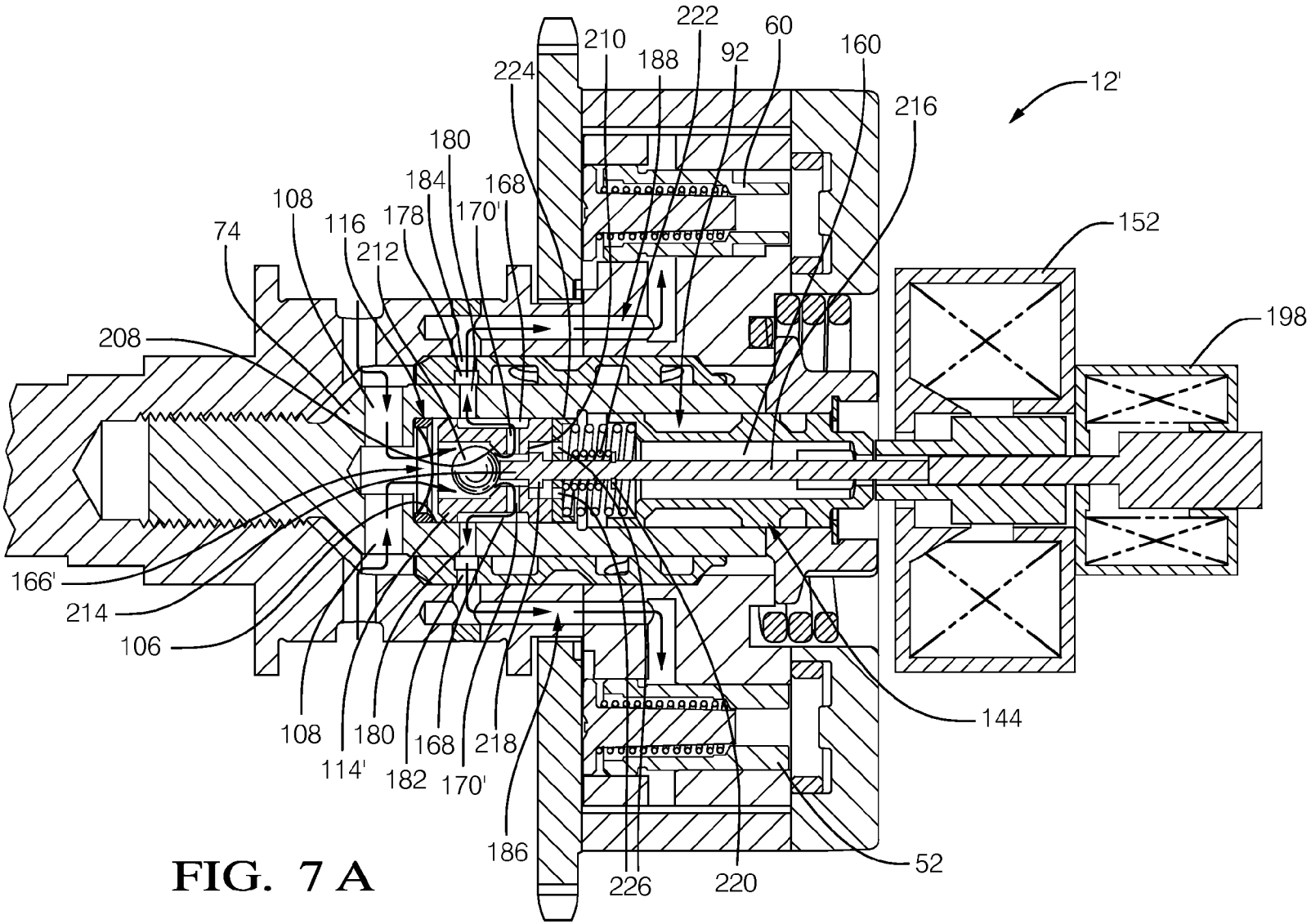
FIG. 7A is an axial cross section of a second embodiment of a camshaft phaser showing a lock pin control valve in a first position for supplying pressurized oil to lock pins of the camshaft phaser for retracting the lock pins from their lock pin seats.
Figure 7A:
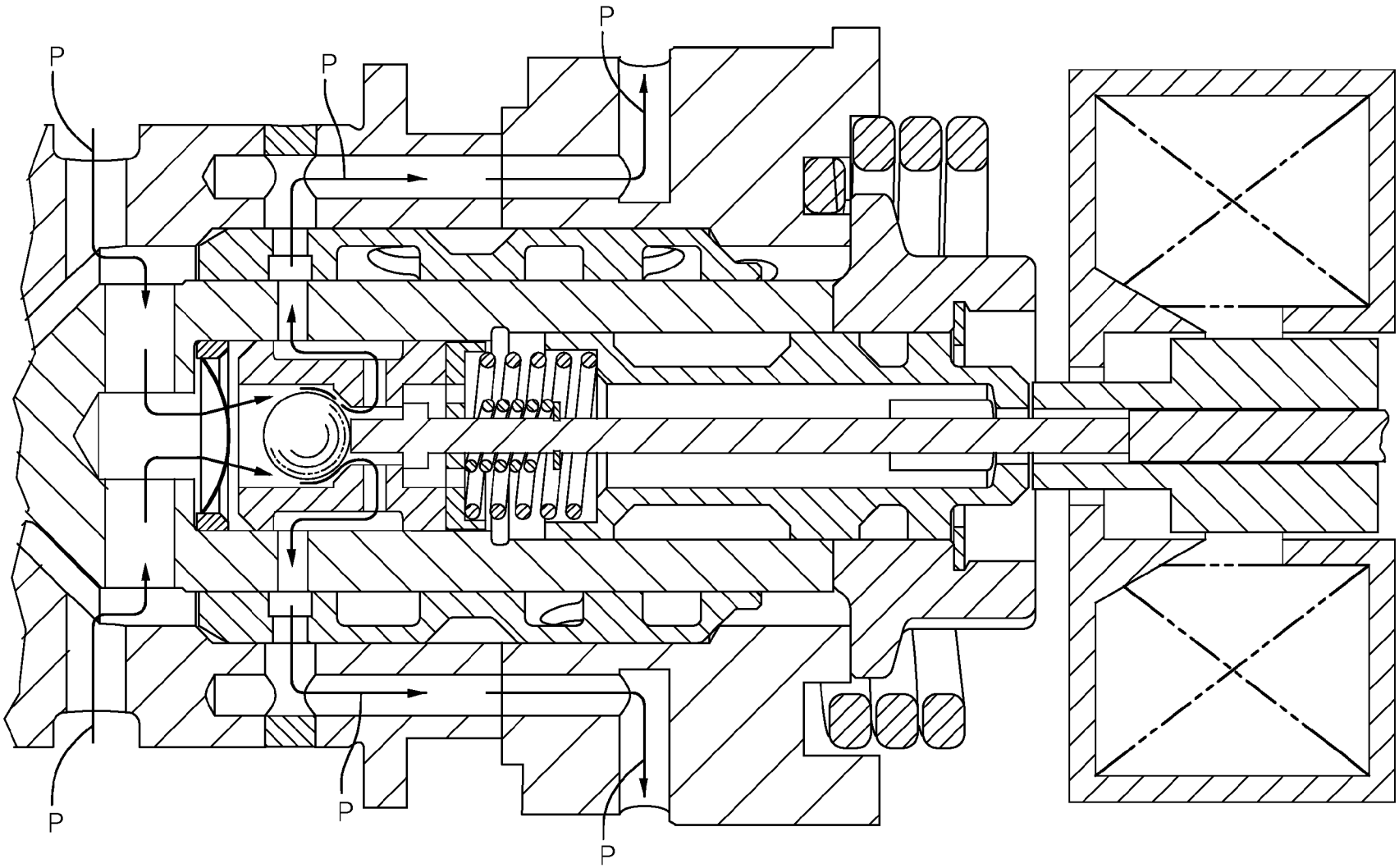

In operation as shown in FIG. 7A, when a change in phase relationship between camshaft 14 and the crankshaft of internal combustion engine 10 is desired, pressurized oil from internal combustion engine 10 is supplied to primary and secondary lock pins 52, 60. This is accomplished by energizing lock pin control valve actuator 198 to seat outer annular rib 218 against vent seat 210 and to unseat ball 212 from supply seat 208. In this way, pressurized oil from internal combustion engine 10 is supplied to annular oil chamber 80 through camshaft oil passages 82 where the path taken by the pressurized oil is represented by arrows. From annular oil chamber 80, the pressurized oil is supplied to blind bore 106 through first radial drillings 108. The pressurized oil is then passed through filter 116 and supplied to manifold central bore 164'. Because outer annular rib 218 is seated against vent seat 210, the pressurized oil is forced to exit manifold central bore 164' through lock pin connecting passages 170' to blind axial grooves 168. The pressurized oil then passes through lock pin drillings 180 which supply the pressurized oil to fifth annular groove 178. Fifth annular groove 178 subsequently supplies the pressurized oil to primary and secondary lock pin drillings 182 and 184 which cause primary and secondary lock pins 52, 60 to retract from primary and secondary lock pin seats 56, 64 respectively. For clarity, FIG. 7A' is provided without reference numbers and without elements that do not define the oil passages to clearly shown the path taken by the pressurized oil as represented by arrows P.

With primary and secondary lock pins 52, 60 now retracted from primary and secondary lock pin seats 56, 64 respectively, the phase relationship phase relationship between camshaft 14 and the crankshaft of internal combustion engine 10 can now be altered. This is accomplished in the same way as in camshaft phaser 12 and will not be further described.

Figure 7B:
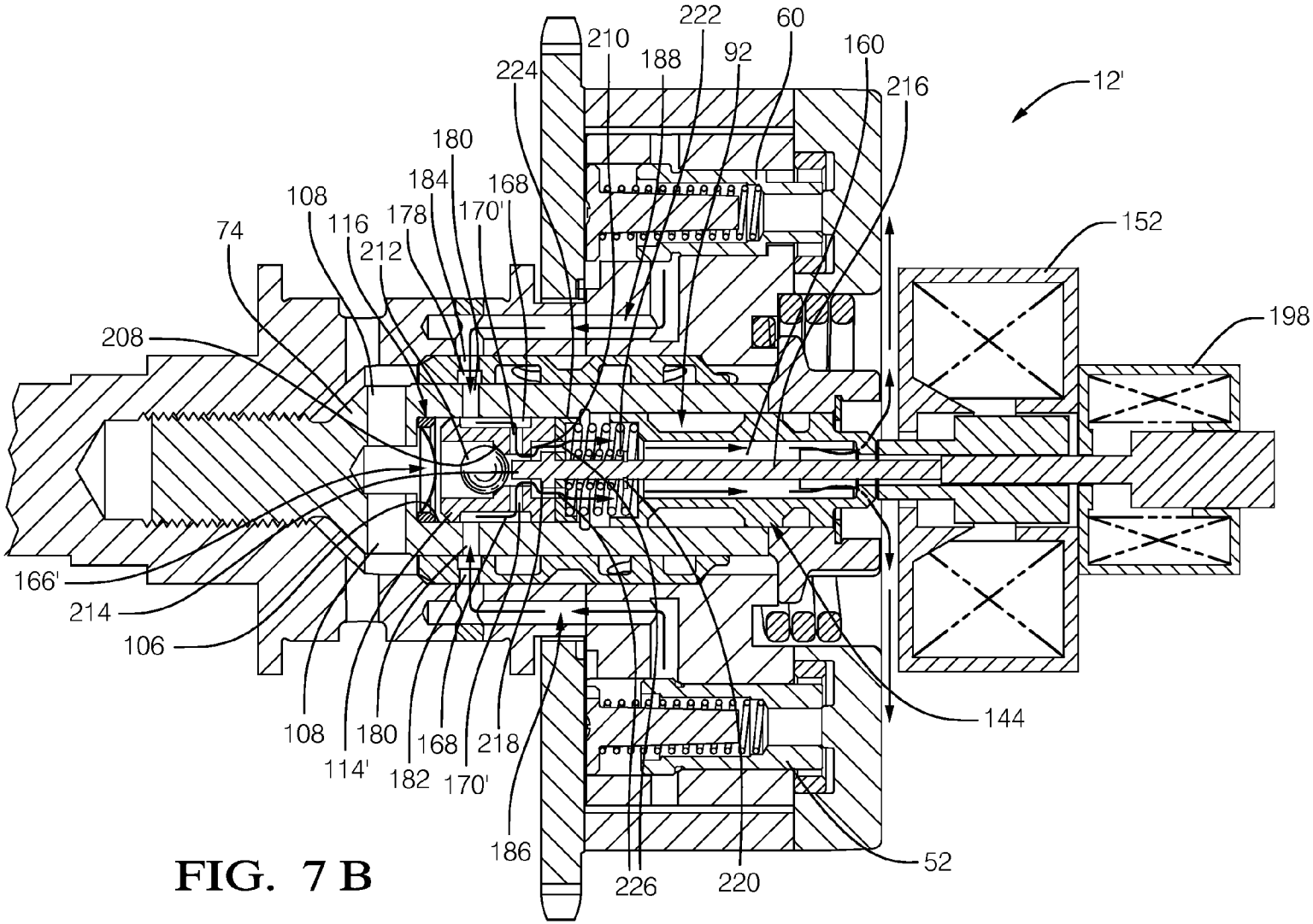
FIG. 7B is an axial cross section of the second embodiment camshaft phaser showing the lock pin control valve in a second position for venting oil from the lock pins for seating the lock pins in their lock pin seats.
Figure 7B:
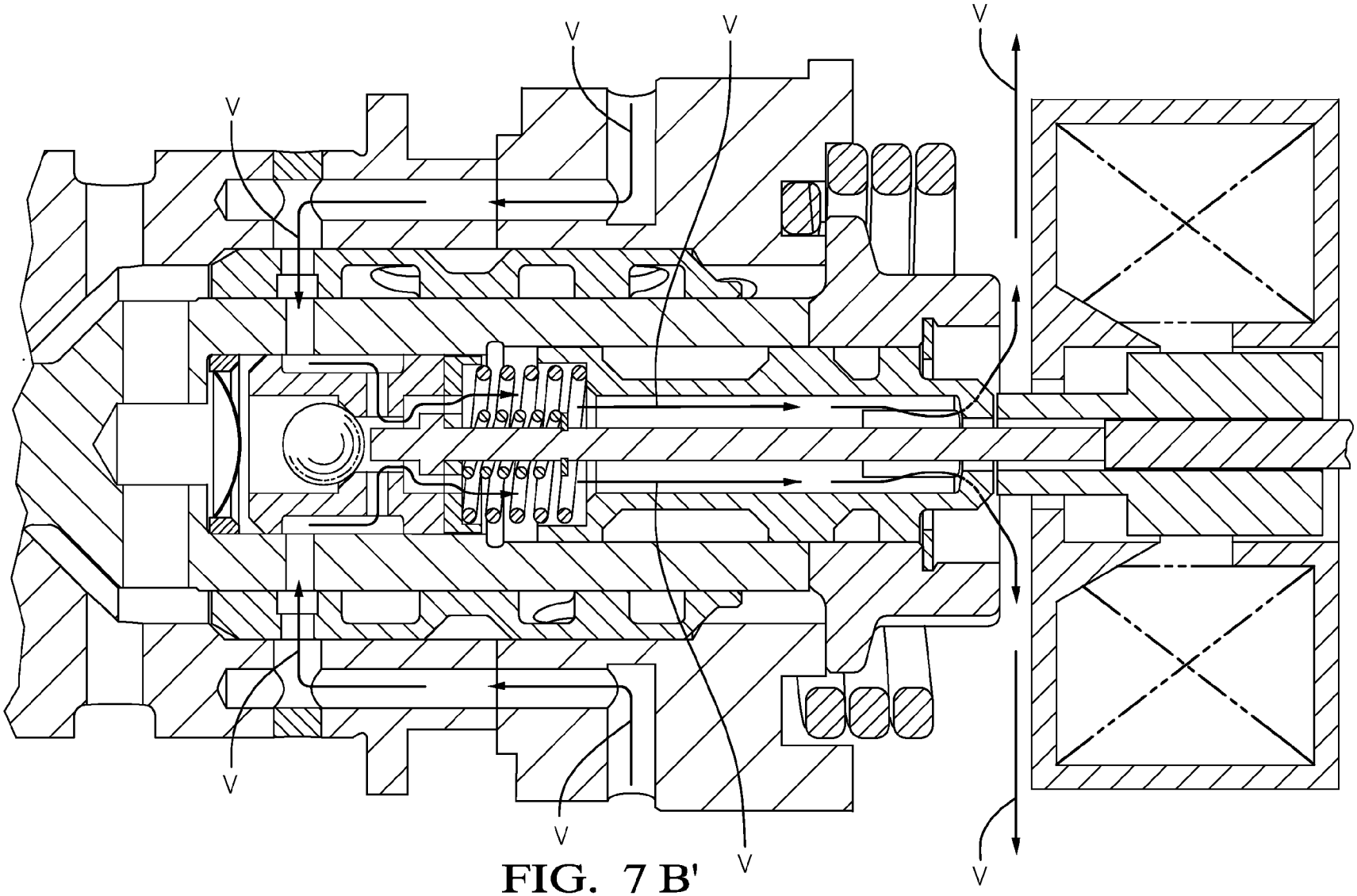
Figure 8A:
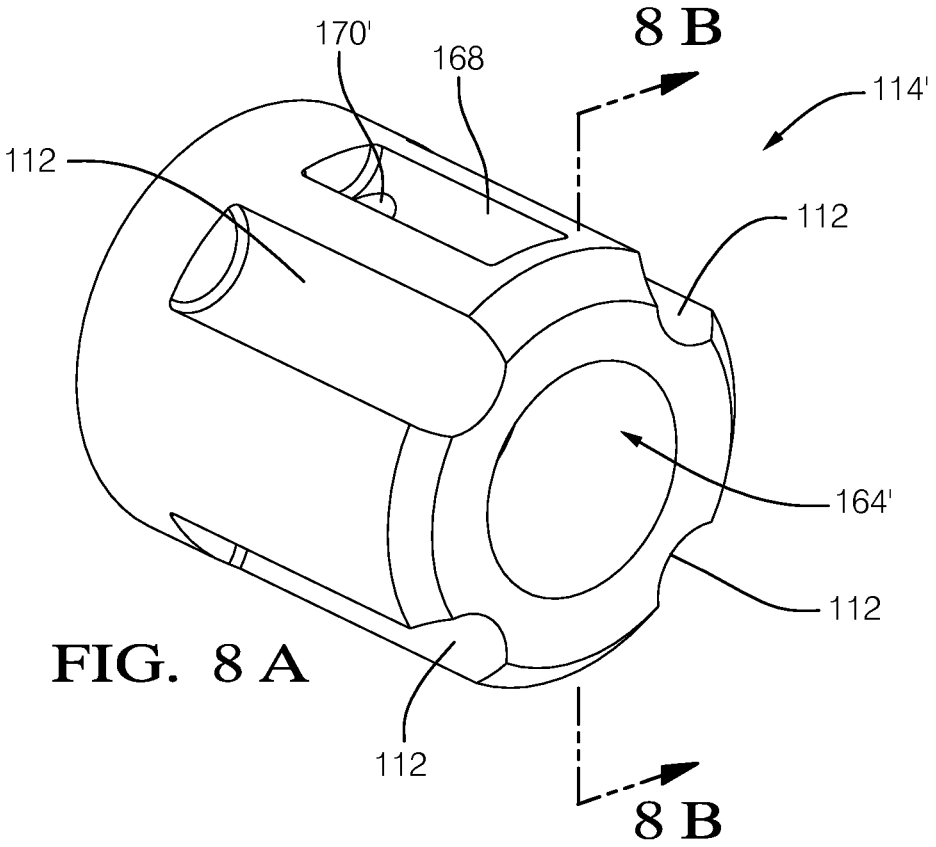
FIG. 8A is an enlarged isometric view of a manifold of the camshaft phaser of the second embodiment.
Figure 8B:
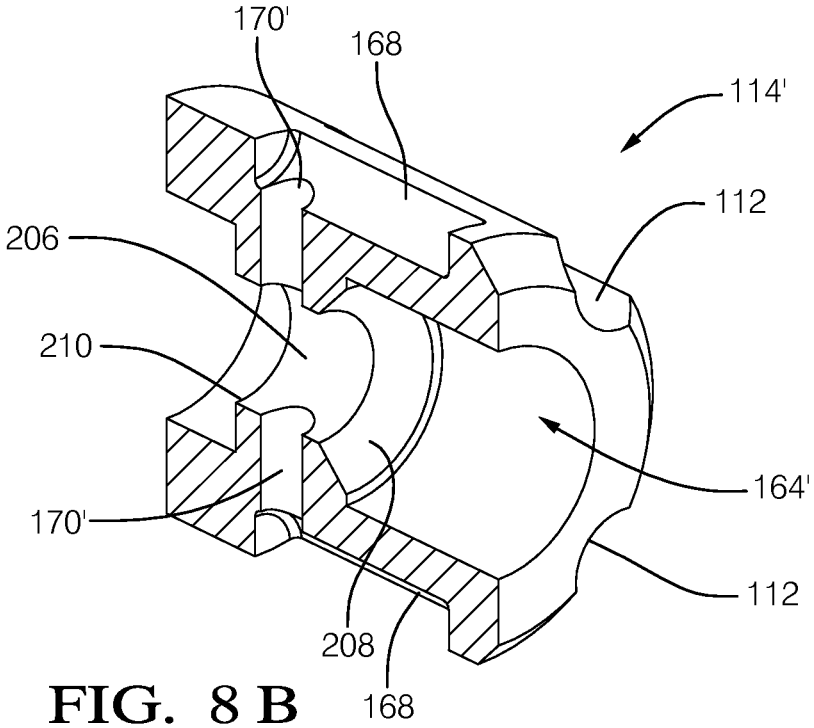
FIG. 8B is an isometric cross-section of the manifold of FIG. 8A.

In operation as shown in FIG. 7B, when it is desired to lock rotor 28 at the predetermined angular position with respect to stator 20, oil is vented from primary and secondary lock pins 52, 60 in order to seat primary and secondary lock pins 52, 60 within primary and secondary lock pin seats 56, 64 respectively. This is accomplished by placing lock pin control valve actuator 198 in an unenergized state of operation. In the unenergized state of operation, lock pin valve spring 222 urges plunger 214 away from ball 212 such that plunger 214 no longer prevents ball 212 from seating against supply seat 208. As a result, pressurized oil from internal combustion engine 10 now seats ball 212 against supply seat 208. In this way, pressurized oil is prevented from being supplied to primary and secondary lock pins 52, 60.

At the same time, outer annular rib 218 is unseated from vent seat 210 which places lock pin connecting passage 170' in fluid communication with central passage 160 of phase relationship valve spool 144. In this way, the oil is vented from primary and secondary lock pins 52, 60 through primary and secondary lock pin passages 186, 188 where the path taken by the vented oil is represented by arrows. The oil from primary and secondary lock pin passages 186, 188 is then passed to fifth annular groove 178 through primary and secondary lock pin drillings 182, 184 respectively before being communicated to blind axial grooves 168 through lock pin drillings 180. The oil is then communicated from blind axial grooves 168 to manifold central bore 164' through lock pin connecting passages 170' before being communicated through axial through holes 226 of plunger guide 224. The oil is then vented through the end of camshaft phaser attachment bolt 74 by passing through central passage 160. Oil communicated through the end of camshaft phaser attachment bolt 74 is shown as hidden lines because the passages therethrough are not visible in this view. For clarity, FIG. 7B' is provided without reference numbers and without elements that do not define the oil passages to clearly show the path taken by the vented oil represented by arrows V.

While internal combustion engine 10 has been described as having camshaft phaser 12 applied camshaft 14, it should now be understood internal combustion engine 10 may include multiple camshafts and that each camshaft may include its own camshaft phaser. It should also be understood that one camshaft may use a camshaft phaser in accordance with the present invention, while the second camshaft phaser may be another type of camshaft phaser, for example, an electrically actuated camshaft phaser. It should also be understood that the present invention applies to both internal combustion engines with a single bank of cylinders and to internal combustion engines with multiple banks of cylinders.

The operation of camshaft phaser 12 has been described as supplying pressurized oil to retard chambers 38 when phase relationship control valve actuator 152 is not energized, while at the same time venting oil from advance chambers 36. It should now be understood that operation of camshaft phaser 12 could also be arranged to supply pressurized oil to advance chambers 36 when phase relationship control valve actuator 152 is not energized, while at the same time venting oil from retard chambers 38. Similarly, the operation of camshaft phaser 12 has been described as supplying pressurized oil to advance chambers 36 when phase relationship control valve actuator 152 is energized, while at the same time venting oil from retard chambers 38. It should now be understood that the operation of camshaft phaser 12 could also be arranged to supply pressurized oil to retard chambers 38 when phase relationship control valve actuator 152 is energized, while at the same time venting oil from advance chambers 36.

While this invention has been described in terms of preferred embodiments thereof, it is not intended to be so limited, but rather only to the extent set forth in the claims that follow.

We claim:

1. A camshaft phaser for controllably varying the phase relationship between a crankshaft and a camshaft in an internal combustion engine, said camshaft phaser comprising:

a stator having a plurality of lobes and connectable to said crankshaft of said internal combustion engine to provide a fixed ratio of rotation between said stator and said crankshaft;

a rotor coaxially disposed within said stator and having a plurality of vanes interspersed with said stator lobes defining alternating advance chambers and retard chambers, wherein said advance chambers receive pressurized oil in order to change the phase relationship between said crankshaft and said camshaft in the advance direction and said retard chambers receive pressurized oil in order to change the phase relationship between said camshaft and said crankshaft in the retard direction, said rotor being attachable to said camshaft of said internal combustion engine to prevent relative rotation between said rotor and said camshaft;

a lock pin disposed within one of said rotor and said stator for selective engagement with a lock pin seat for substantially preventing relative rotation between said rotor and said stator when said lock pin is engaged with said lock pin seat, wherein pressurized oil is selectively supplied to said lock pin in order to disengage said lock pin from said lock pin seat, and wherein oil is selectively vented from said lock pin in order to engage said lock pin with said lock pin seat;

a phase relationship control valve for controlling the flow of oil into and out of said advance and retard chambers, wherein said phase relationship control valve is coaxial with said rotor; and a lock pin control valve for controlling the flow of oil to and from said lock pin, wherein said lock pin control valve is coaxial with said phase relationship control valve;

wherein said phase relationship control valve is operational independent of said lock pin control valve.

2. A camshaft phaser as in claim 1 further comprising a camshaft phaser attachment bolt extending coaxially through said rotor and said stator and threadably engageable into said camshaft to attach said camshaft phaser to said camshaft, wherein said phase relationship control valve and said lock pin control valve are disposed within a blind bore of said camshaft phaser attachment bolt.

3. A camshaft phaser as in claim 2 wherein said lock pin control valve comprises:

a hollow cylindrical manifold press fit within said blind bore and defining a manifold central bore; and a lock pin valve spool within said manifold central bore and axially moveable between a lock pin disengaging position and a lock pin engaging position such that said lock pin disengaging position supplies pressurized oil to said lock pin and said lock pin engaging position vents oil from said lock pin.

4. A camshaft phaser as in claim 3 wherein said lock pin control valve further comprises a lock pin valve spool spring for biasing said lock pin valve spool to said lock pin engaging position, wherein said lock pin valve spool spring is grounded to said hollow cylindrical manifold.

5. A camshaft phaser as in claim 4 wherein said lock pin valve spool spring is located within said hollow cylindrical manifold.

6. A camshaft phaser as in claim 3 wherein said phase relationship control valve comprises:

a phase relationship valve spool within said blind bore of said camshaft phaser attachment bolt and axially moveable within said blind bore to selectively supply pressurized oil to said advance chambers and to selectively supply pressurized oil to said retard chambers; and a phase relationship spool spring for biasing said phase relationship valve spool to a position for supplying pressurized oil to one of said advance chambers and said retard chambers, wherein said phase relationship spool spring is grounded to said camshaft phaser attachment bolt by a seat formed on said hollow cylindrical manifold.

7. A camshaft phaser as in claim 3 wherein said hollow cylindrical manifold directs pressurized oil to said phase relationship control valve.

8. A camshaft phaser as in claim 1 further comprising a phase relationship control valve actuator for actuating said phase relationship control valve and a lock pin control valve actuator for actuating said lock pin control valve.

* * * * *